US005217855A

United States Patent [19]

Okada et al.

[11] Patent Number: 5,217,855

[45] Date of Patent: Jun. 8, 1993

[54] PROCESSING COMPOSITION FOR SILVER HALIDE COLOR PHOTOGRAPHIC MATERIAL AND PROCESSING METHOD

[75] Inventors: Hisashi Okada; Morio Yagihara; Shigeru Nakamura, all of Kanagawa, Japan

[73] Assignee: Fuji Photo Film Co., Ltd., Kanagawa, Japan

[21] Appl. No.: 735,558

[22] Filed: Jul. 25, 1991

[30] Foreign Application Priority Data

Jul. 25, 1990 [JP] Japan ..... 2-196972
Jun. 3, 1991 [JP] Japan ..... 3-157442

[51] Int. Cl.[5] ..... G03C 5/26

[52] U.S. Cl. ..... 430/488; 430/393; 430/430; 430/491; 562/11; 562/442; 562/561; 564/86; 564/98

[58] Field of Search ..... 562/11, 442, 561; 564/86, 98; 430/393, 430, 461, 491, 488, 460

[56] References Cited

U.S. PATENT DOCUMENTS

| | | | |
|---|---|---|---|
| 3,314,935 | 4/1967 | Booth et al. | 564/86 |
| 3,567,746 | 3/1971 | Shetty | 564/86 |
| 4,094,635 | 6/1978 | Bugaut et al. | 564/99 |
| 4,804,618 | 2/1989 | Ueda et al. | 430/491 |

*Primary Examiner*—Hoa Van Le
*Attorney, Agent, or Firm*—Sughrue, Mion, Zinn, Macpeak & Seas

[57] ABSTRACT

A photographic processing composition containing at one compoud represented by formula (I)

(I)

wherein $R_1$ represents a hydrogen atom, an aliphatic group, or an aromatic group, $L_1$ and $L_2$ each represents a divalent bonding group including an alkylene group and/or an arylene group; X represents a group (wherein $R_a$, $R_b$ and $R_c$ each represents a hydrogen atom, an aliphatic group or an aromatic group, and $R_d$ represents an aliphatic group or an aromatic group); and Y represents a carboxy group, a hydroxy group, a phosphono group, a sulfo group or a salt thereof. The processing composition does not produce precipitate or sludge even when contaminated by metallic ions. A processing method using the processing composition is also disclosed.

6 Claims, No Drawings

PROCESSING COMPOSITION FOR SILVER HALIDE COLOR PHOTOGRAPHIC MATERIAL AND PROCESSING METHOD

FIELD OF THE INVENTION

The present invention relates to a processing composition for silver halide color photographic materials and a process using the processing composition, and more particularly to a processing composition containing a novel chelating agent capable of sequestering metal ions harmful to photographic processings and a process using the processing composition. The present invention also relates to a photographic processing composition containing a novel bleaching agent for use in a bleaching stage after color development and a process for processing a silver halide color photographic material by using the processing composition.

BACKGROUND OF THE INVENTION

Basically, silver halide black-and-white photographic materials are subjected to black-and-white development, fixation, rinsing, etc., after imagewise exposure; silver halide color photographic materials (hereinafter referred to as color photographic material) are subjected to color development, desilvering, rinsing, stabilizing, etc., after imagewise exposure; and silver halide color reversal photographic materials are subjected to black-and-white development, reversal processing, color development, desilvering, rinsing, stabilizing, etc., after imagewise exposure.

In the color development stage, sensitized silver halide grains are reduced by a color developing agent to form silver, and at the same time, the formed oxidant of the color developing agent is reacted with couplers to form an image dye.

In the desilvering stage subsequent to the development stage, developed silver formed in the development stage is oxidized into a silver salt by a bleaching agent having an oxidative effect (bleaching), and the silver salt and unexposed silver halide are converted into soluble salts by a fixing agent and removed from sensitive layers (fixing). Bleaching and fixing are carried out separately as a bleaching stage and a fixing stage. Alternatively, bleaching and fixing are simultaneously carried out as a bleaching-fixing (blixing) stage. The details of these processing stages are described in James, *The Theory of Photographic Process,* 4th edition (1977), *Research Disclosure* No. 17643 pp. 28–29, Ibid No. 18716 p. 651 (left to right columns) and Ibid No. 307105 pp. 880–881.

In addition to the above-described basic processing stage, various auxiliary stages such as a rinse stage, stabilization stage, hardening stage, stop stage, etc. are performed to maintain the photographic and physical quality of a dye image or to maintain stability during processing.

The above mentioned processing stages are normally effected in an automatic developing machine. In recent years, photograhic processing is effected in various places such as large-scale photofinishing laboratories equipped with large-sized automatic developing machine and photo processing shops equipped with small-sized automatic developing machine called mini-laboratory. This has often caused deterioration in processing properties.

One of the main reasons for this trouble is contamination of metallic ions in the processing solution.

Various metallic ions enter into the processing solution through various paths. For example, calcium, magnesium or iron ions or calcium contained in gelatin in the light-sensitive material enter into the processing solution with water to be used in the preparation of the processing solution. When the blix solution splashes, iron chelate incorporated therein enters into its prebath, i.e., development bath. When a film impregnated with the processing solution enters into the subsequent bath, ions contained in the processing solution may contaminate the subsequent bath.

The effects of ions which have entered into the processing solution depend on the kind of ions and the processing solution.

Calcium and magnesium ions which have entered into the developer react with carbonates used as buffer to produce precipitate or sludge which causes clogging of filter in the circulation system in the developing machine or contamination of film. The contamination of the developer with transition metal salts such as iron ion causes decomposition of a p-phenylenediamine color developing agent, black-and-white developing agent such as hydroquinone and monol or preservative such as hydroxylamine and sulfite, which leads to a drastic deterioration of photographic properties.

Further, when transition metal ions such as iron ion enter into a bleaching solution containing hydrogen peroxide or persulfate, they also drastically deteriorate the stability of the bleaching solution, causing problems such as poor bleach.

When a commonly used fixing solution comprising a thiosulfate is contaminated by a transition metal salt, its stability is deteriorated, causing the production of stain or sludge in the solution. This results in clogging of filter in the automatic developing machine which causes a drop in the circulated amount of the solution that leads to poor fixation or stain on the film. This phenomenon in the fixing solution can be seen in the washing water in the rinse stage following the fixing stage. In particular, when the amount of washing water is reduced, the percent exchange of solution in the tank is reduced, extremely facilitating decomposition of thiosulfate called sulfuration or precipitation of silver sulfide.

When these phenomena occur, critical stain often occur on the surface of film.

When a stabilizing solution prepared from hard water containing large amounts of calcium and magnesium is used, these impurities serve as nutriments from which bacteria grow, causing stain in the solution and on the film. Further, when transition metal ions such as iron ion enter into the stabilizing solution, these ions are left in the film, deteriorating the storability of the film after processing.

As has been described, the contamination of the processing solution with metallic ions cause various problems. Thus, it has been keenly desired to provide effective ion hiding agents.

As one of approaches for eliminating these problems, chelating agents for hiding metallic ions have been used. Examples of these chelating agents include aminopolycarboxylic acids (e.g., ethylenediaminetetraacetic acid, diethylenetriaminepentaacetic acid) as described in JP-B-48-30496 and 44-30232 (the term "JP-B" as used herein means an "examined Japanese patent publication"), organic phosphonic acids as described in JP-A-

56-97347 (the term "JP-A" as used herein means an "unexamined published Japanese patent application"), JP-B-56-39359 and West German Patent 2,227,639, phosphonocarboxylic acids as described in JP-A-52-102726, 53-42730, 54-121127, 55-126241, and 55-65956, and compounds as described in JP-A-58-195845 and 58-203440, and JP-B-53-40900.

Some of these compounds have been put into practical use. However, the properties of these compounds leave much to be desired. For example, ethylenediaminetetraacetic acid exhibits a high effect of hiding calcium ion, but when incorporated in the developer, it accelerates the decomposition of developing agent or preservative for developing agent in the presence of iron ion, causing deterioration of photographic properties, e.g., drop in image density and increase in fog. Alkylidenediphosphonic acid does not give such an adverse effect even in the presence of iron ion, but when incorporated in a processing solution prepared from hard water containing much calcium ions, it causes the production of a solid matter that causes malfunction of the developing machine.

In recent years, as the demand for environmental protection grows, the replenishment rate of photographic processing solutions has been reduced more and more. Under these circumstances, the retention time of the processing solutions in the developing machine has become longer. Thus, the deterioration of the storability of the film becomes even more remarkable than before. Therefore, it has been desired to develop an excellent novel chelating agent which effectively hides metallic ions accummulated in the processing solutions without causing any troubles.

In the field of processing of color photographic materials, a rapid processing service has been provided for customers with the spread of mini-laboratory.

However, ferric complexes of ethylenediaminetetraacetic acid which have heretofore been used as bleaching agents in the bleaching or blix stage in the processing of color photographic materials have a basic disadvantage that they have a weak oxidizing power. Despite some improvements such as use of some bleach accelerators (e.g., mercapto compounds as described in U.S. Pat. No. 1,138,842), the target, i.e., rapid bleach cannot be attained.

As bleaching agents for attaining rapid bleach there have been known red prussiate, iron chloride, bromate, etc. However, red prussiate cannot be widely used due to envrionmental protection problems. Iron chloride cannot be widely used due to poor handleability caused by metal corrosion. Bromate cannot be widely used due to solution instability.

Therefore, it has been desired to provide a bleaching agent which exhibits an excellent handleability and attains a rapid bleach without any problems in discharge of waste liquid.

In recent years, as bleaching agents which satisfy these requirements there have been disclosed ferric complexes of 1,3-diaminopropanetetraacetic acid.

However, these bleaching agents are disadvantageous in that they cause bleach fog upon bleach. As an approach for eliminating bleach fog there has been disclosed a method which comprises the incorporation of a buffer in the bleaching solution (e.g., JP-A-1-213657). However, this improvement leaves much to be desired. In particular, when this approach is employed in a rapid processing wherein color development is effected within 3 minutes with a highly active developer, it causes much more bleach fog.

Further, when a processing solution having a bleaching capacity and comprising a ferric complex of 1,3-diaminopropanetetraacetic acid is used, stain becomes more remarkable during storage after processing.

Moreover, when continuous processing is effected with a processing solution having a bleaching capacity and comprising a ferric complex of 1,3-diaminopropanetetraacetic acid, there are caused some problems such as drastic deterioration of desilvering properties and production of precipitate. Thus, it has been desired to provide an alternate novel processing composition having a bleaching capacity and a processing method using the processing composition.

SUMMARY OF THE INVENTION

It is therefore an object of the present invention to provide a photographic processing composition which does not produce precipitate or sludge even when contaminated by metallic ions and a processing method using the processing composition.

It is another object of the present invention to provide a stable processing composition which does not cause reduction in the effective components in the processing solution or production of components that give any photographically adverse effects when contaminated by metallic ions and a processing method using the processing composition.

It is yet another object of the present invention to provide a processing composition which provides for improvements in the inhibition of deterioration of image storability caused by the remaining of metallic ions as processing components in the light-sensitive material processed and a processing method using the processing composition.

It is further object of the present invention to provide a processing composition which exhibits an excellent handleability and causes no environmental problems with waste liquid and a processing method using the processing composition.

It is still further object of the present invention to provide a processing composition having a bleaching capacity which exhibits excellent desilvering properties and a processing method using the processing composition.

It is further object of the present invention to provide a processing composition having a bleaching capacity which causes little bleach fog and a processing method using the processing composition.

It is further object of the present invention to provide a processing composition having a bleaching capacity which causes little stain with time and a processing method using the processing composition.

It is further object of the present invention to provide a processing composition which can stably maintain the above mentioned properties even under running processing conditions and a processing method using the processing composition.

These and other objects of the present invention will become more apparent from the following detailed description and examples.

These objects of the present invention are accomplished with a processing composition containing at least one of compounds represented by the general formula (I) described below and a processing method using the processing composition.

These objects of the present invention are also accomplished with a processing composition for silver halide color photographic material containing a chelate compound of a compound represented by formula (I) with Fe(III), Mn(III), Co(III), Rh(II), Rh(III), Au(II), Au(III) or Ce(IV) and a processing method using the processing composition.

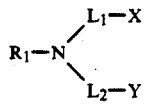

(I)

In formula (I), $R_1$ represents a hydrogen atom, an aliphatic group, or an aromatic group, $L_1$ and $L_2$ each represents a divalent bonding group including an alkylene group and/or an arylene group; X represents a

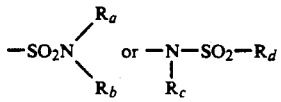

group (wherein $R_a$, $R_b$ and $R_c$ each represents a hydrogen atom, an aliphatic group or an aromatic group, and $R_d$ represents an aliphatic group or an aromatic group); and Y represents a carboxy group, a hydroxy group, a phosphono group, a sulfo group or a salt thereof.

DETAILED DESCRIPTION OF THE INVENTION

The compounds represented by formula (I) are illustrated in more detail below.

In formula (I), $R_1$ represents a hydrogen atom, an aliphatic group which may be substituted or an aromatic group which may be substituted. The aliphatic group represented by $R_1$ includes a straight-chain, branched or cyclic alkyl, alkenyl or alkynyl group having preferably up to 10 carbon atoms. More preferably, the aliphatic group is an alkyl group. Particularly desirable is an alkyl group having 1 to 4 carbon atoms. The aromatic group represented by $R_1$ includes a monocyclic or bicyclic aryl group such as phenyl group or naphthyl group, with phenyl group being more preferred.

Examples of substituent groups for $R_1$ include an alkyl group (e.g., methyl, ethyl), an aralkyl group (e.g., phenylmethyl), an alkenyl group (e.g., allyl), an alkynyl group, an alkoxy group (e.g., methoxy, ethoxy), an aryl group (e.g., phenyl, p-methylphenyl), an amino group (e.g., dimethylamino), an acylamino group (e.g., acetylamino), a sulfonylamino group (e.g., methanesulfonyl amino), a ureido group, a urethane group, an aryloxy group (e.g., phenyloxy), a sulfamoyl group (e.g., methylsulfamoyl), a carbamoyl group (e.g., carbamoyl, methylcarbamoyl), an alkylthio group (e.g., methylthio), an arylthio group (e.g., phenylthio), a sulfonyl group (e.g., methanesulfonyl), a sulfinyl group (e.g., methanesulfinyl), a hydroxyl group, a halogen atom (e.g., chlorine, bromine, fluorine), a cyano group, a sulfo group, a carboxyl group, a phosphono group, an aryloxycarbonyl group (e.g., phenyloxycarbonyl), an acyl group (e.g., acetyl, benzoyl), an alkoxycarbonyl group (e.g., methoxycarbonyl), an acyloxy group (e.g., acetoxy), a carbonamido group, a sulfonamido group, a nitro group and a hydroxamic acid group.

Y represents —OH, $—COOM^1$, $—PO_3M^2M^3$ or $—SO_3M^4$ (wherein $M^1$, $M^2$, $M^3$ and $M^4$ each represents a hydrogen atom or a cation; examples of the cation include an alkali metal (e.g., lithium, sodium; potassium), ammonium and pyridinium). Y is more preferably $—COOM^1$.

$L_1$ and $L_2$ each represents a divalent bonding group including an alkylene group and/or an arylene group. Preferably, the divalent bonding group is an alkylene group having 1 to 6 carbon atoms; an arylene group having 6 to 10 carbon atoms; or a group comprising a combination of —O—, —S—, —COO—,

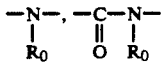

(wherein $R_0$ is a hydrogen atom, an alkyl group, an aryl group or a hydroxyl group) or

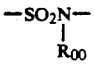

(wherein $R_{00}$ is hydrogen atom, an alkyl group or an aryl group) with an alkylene group or an arylene group. If possible, the divalent bonding group may comprise a combination of these groups. These divalent bonding groups may be substituted. Examples of substituent groups include those already described above as substituent groups for $R_1$.

Preferred for the $L_1$ and $L_2$ groups are those represented by the formula (L).

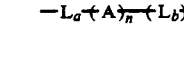

(L)

wherein $L_a$ and $L_b$ each represents an alkylene group or an arylene group; A represents —O—, —S—, —COO—,

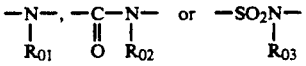

(wherein $R_{01}$, $R_{02}$ and $R_{03}$ each represents a hydrogen atom, a hydroxy group, an alkyl group which may be substituted, or an aryl group which may be substituted); m and n each independently represents 0 or 1; and the mark * represents the position where the group is attached to X or Y in formula (I). Examples of substituent groups for $R_{01}$, $R_{02}$ and $R_{03}$ include those described above as substituent groups for $R_1$.

Preferred examples of $L_1$ and $L_2$ include the following groups.

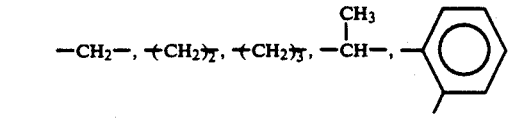

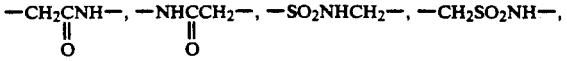

-continued

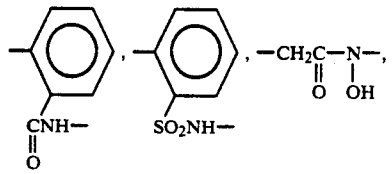

$-CH_2COCH_2CH_2-$, $-CH_2CH_2OCH_2CH_2-$, $-CH_2CH_2SCH_2CH_2-$, $-CH_2CH_2NHCH_2CH_2-$.

More preferably, $L_1$ and $L_2$ are groups of formula (L) where n=0 and m=0. Alkylene groups having 1 to 3 carbon atoms are most preferred for $L_1$ and $L_2$, with a methylene group and an ethylene group being particularly preferred. X in formula (I) represents

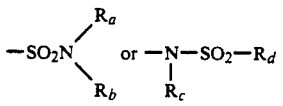

wherein $R_a$, $R_b$ and $R_c$ each represents a hydrogen atom, an aliphatic group or an aromatic group; and $R_d$ represents an aliphatic group or an aromatic group. The aliphatic group represented by $R_a$, $R_b$, $R_c$ and $R_d$ includes a straight-chain, branched or cyclic alkyl, alkenyl or alkynyl group preferably having up to 10 carbon atoms. The aromatic group represented by $R_a$, $R_b$, $R_c$ and $R_d$ is a monocyclic or bicyclic aryl group such as phenyl group or naphthyl group with phenyl group being preferred.

The aliphatic group or the aromatic group represented by $R_a$, $R_b$, $R_c$ and $R_d$ may be substituted. Examples of substituent groups include those already described above in the definition of the substituent groups for $R_1$. $R_a$ and $R_b$ or $R_c$ and $R_d$ may be combined together to form a ring.

Among the compounds represented by formula (I), compounds represented by the following formula (II) or (III) are preferred.

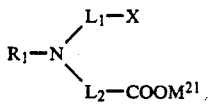

(II)

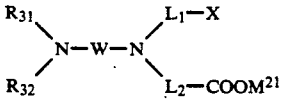

(III)

In the above formulas, $R_1$, $L_1$, $L_2$ and X are the same as those set forth in formula (I); and $M^{21}$ represents a hydrogen atom or a cation (e.g., an alkali metal (e.g., lithium, sodium, potassium, etc.), ammonium, pyridinium, etc.).

$R_{31}$ and $R_{32}$ are the same meaning as $R_1$ in formula (I); and $R_{31}$, $R_{32}$ and $L_1$-X may be the same or different groups. It is preferred that at least one of $R_{31}$ and $R_{32}$ is $-L_2-COOM^{21}$ or $-L_3-X$ (wherein $L_3$ has the same meaning as $L_1$ in formula (I) and X is as defined above in formula (I)).

More preferably, $R_{31}$ is $-L_2-COOM^{21}$, and $R_{32}$ is $-L_2-COOM^{21}$ or $-L_3-X$. $R_{31}$ and $R_{32}$ are particularly preferably $-L_2COOM^{21}$ and $-L_3-X$, respectively.

W in formula (III) represents a divalent bonding group. The divalent bonding group is a group represented by $$\text{-}(W^1-D)_s-W^2-$$

(wherein $W^1$ and $W^2$ each represents an alkylene group having 2 to 8 carbon atoms, an arylene group having 6 to 10 carbon atom, an aralkylene group having 7 to 10 carbon atom or a cycloalkylene group having 5 to 10 carbon atoms; D represents —O—, —S— or

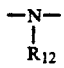

(wherein $R_{12}$ represents a hydrogen atom, a hydrocarbon group, $-L_A-COOM^1$, $-L_APO_3M^2M^3$, $-L_A-OH$ or $-L_A-SO_3M^4$ (wherein $L_A$ represents an alkylene group having 1 to 8 carbon atoms or an arylene group having 6 to 10 carbon atoms; and $M^1$, $M^2$, $M^3$ and $M^4$ each represents a hydrogen atom or a cation (e.g., an alkali metal, ammonium, etc.)); and s represents 0 to 3).

These divalent bonding groups may be substituted. Examples of substituent groups include those already described above in the definition of the substituent groups for $R_1$ in formula (I). Preferably, W is a group where s is 0 to 2, and more preferably, s is 0 or 1. Particularly preferably s is 0.

Examples of W include the following groups.

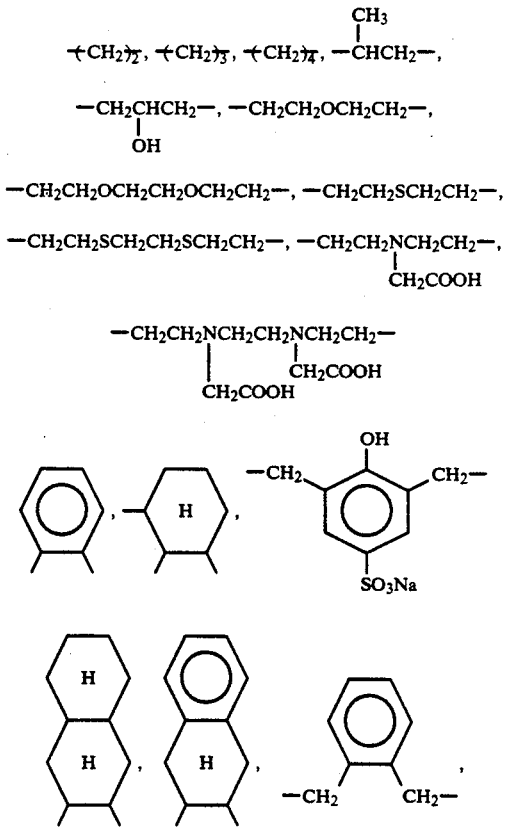

-continued
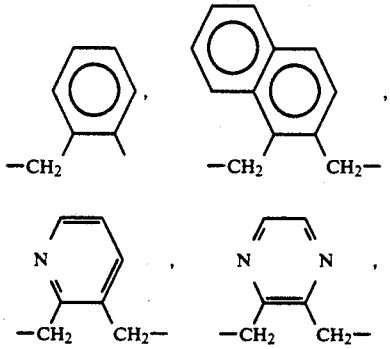
-continued
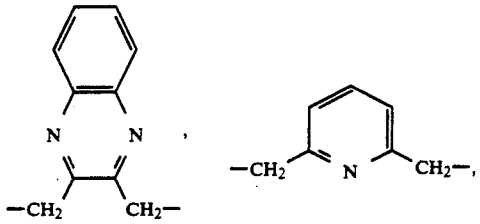
Examples of the compounds represented by formula (I) include, but are not limited to, the following compounds.
1.
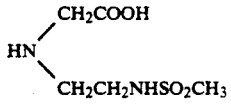
2.
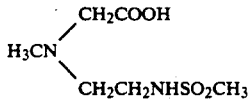
3.
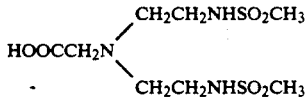
4.
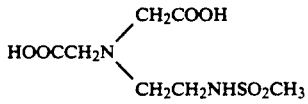
5.
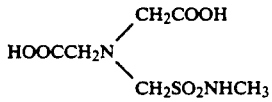
6.
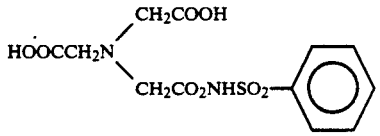
7.
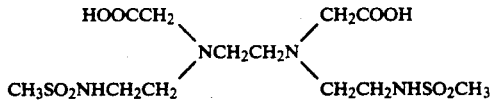
8.
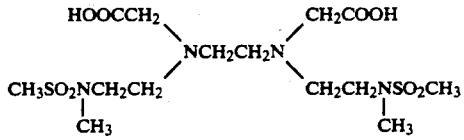
9.
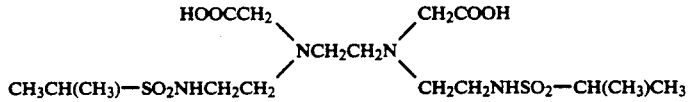
10.
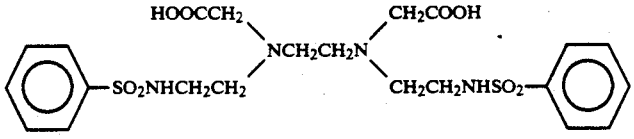

-continued
11.
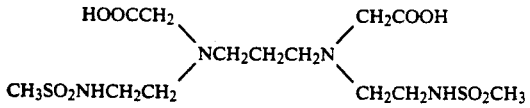
12.
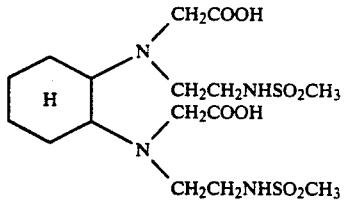
13.
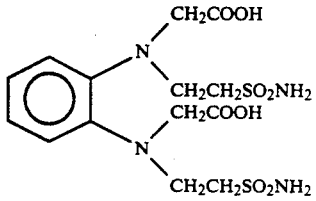
14.
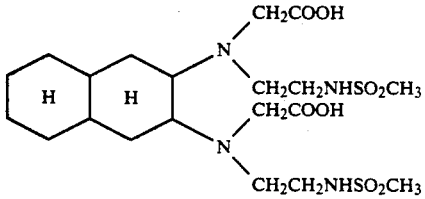
15.
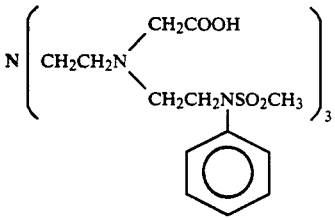
16.
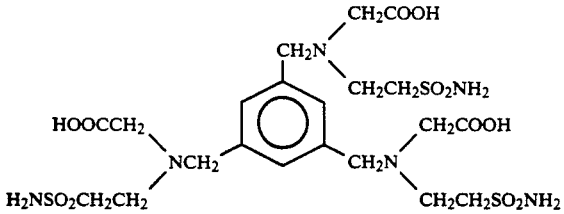
17.
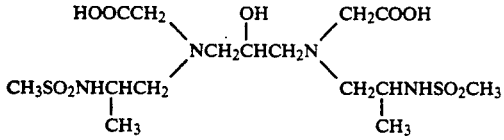
18.
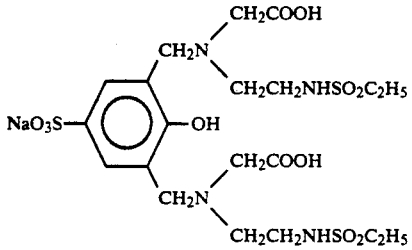

-continued
19.
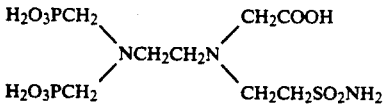
20.
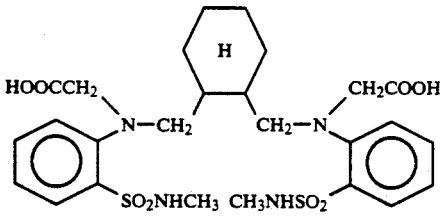
21.
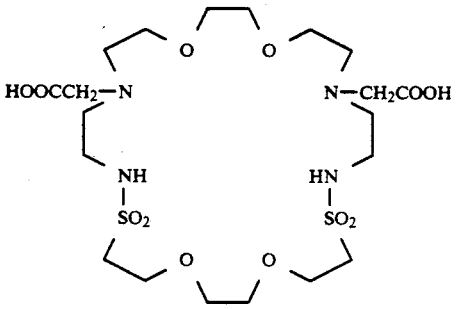
22.
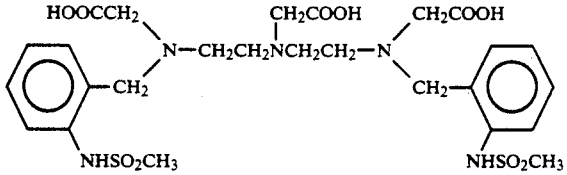
23.
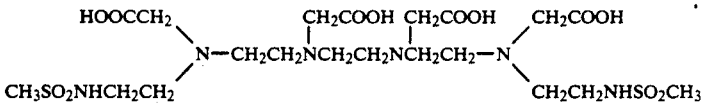
24.
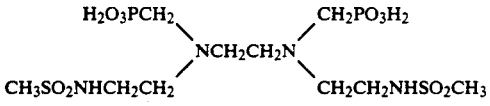
25.
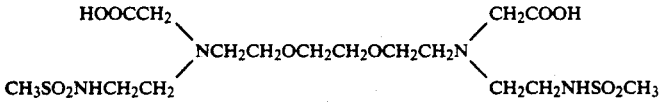
26.
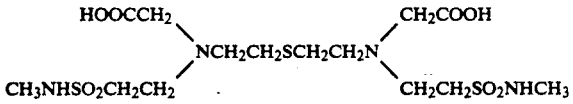
27.
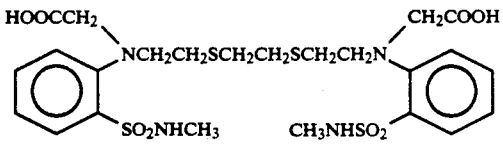
28.
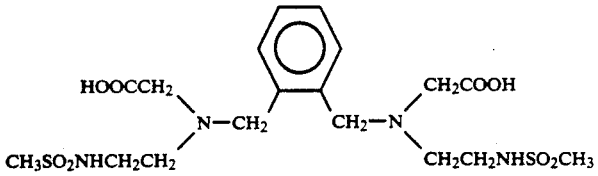

-continued

29.

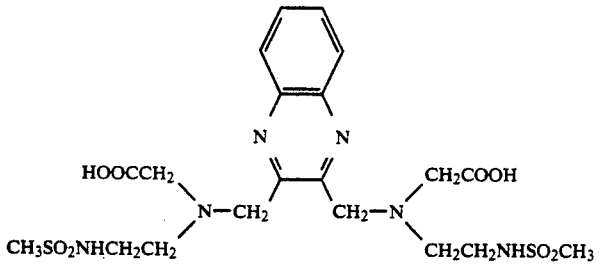

30.

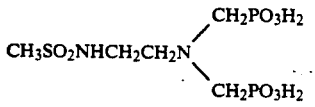

31.

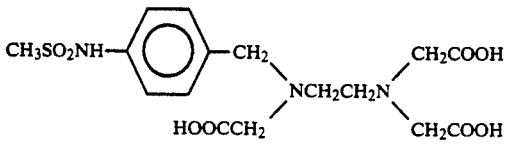

32.

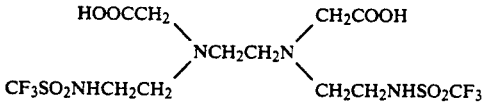

33.

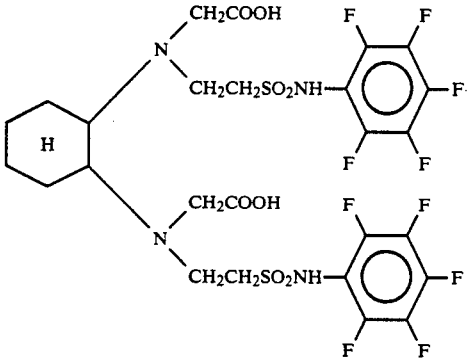

34.

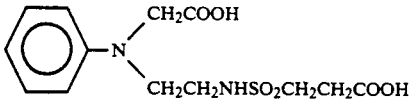

35.

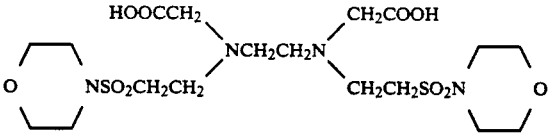

36.

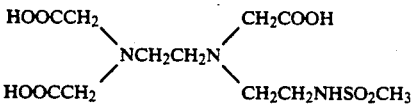

37.

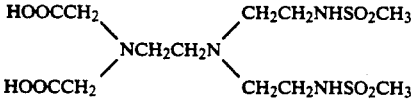

The synthesis of the compound represented by formula (I) can be accomplished by the method as described hereinafter.

In particular, an alkane containing a sulfonamide substituent and a separatable group (e.g., 2-chloroethylmethanesulfonamide, 2-chloroethylpentasulfonamide, 3-chloropropylmethanesulfonamide) and an amine compound (e.g., iminodiacetic acid, nitrilodipropionic acid) may be allowed to undergo reaction in the presence of a base to prepare the compound represented by formula (I).

Further, an alkane containing a sulfonamide substituent and a carbonyl group (e.g., 2-methanesulfonamideethanal, 3-methanesulfonamidepropanal, 2-trifluoromethanesulfonamideethanal) and an amine compound (e.g., amine compounds as mentioned above) may be allowed to undergo hydrogenation reaction to prepare the compound represented by formula (I). These starting materials are known and commercially available.

The above mentioned reactions of the present invention are normally effected in a solvent. Such a solvent is not specifically limited so far as it does not participate in these reactions. In particular, water, alcohol (e.g., lower alcohol such as methanol) or the like can be advantageously used to promote these reactions.

As separatable group to be incorporated in the alkane there can be normally used one used for alkylation of amino group. Examples of such a separatable group include halogen atom (e.g., chlorine, bromine, iodine), and p-toluenesulfonate. Examples of base to be used in these reactions include alkali and tertiary amine (e.g., triethylamine).

The amount of the base to be used is in the range of equimolar amount to 10 times, preferably equimolar amount to 4 times the molar amount of alkane. If the synthesis is effected by hydrogenation reaction, a catalyst with palladium, platinum or cobalt supported on activated charcoal or Raney nickel catalyst can be used.

The reaction temperature is in the range of 0° to 100° C., preferably 10° C. to 70° C.

SYNTHESIS EXAMPLE 1: Synthesis of Compound 4

35.7 g (0.30 mol) of iminodiacetic acid was dissolved in 120 ml (0.600 mol) of 5N sodium hydroxide. While the solution was stirred at a temperature of 50° C, 47.3 g (0.30 mol) of 2-chloroethylmethanesulfonamide and 60 ml (0.300 mol) of 5N sodium hydroxide were slowly added dropwise to the solution in such a manner that the pH value of the reaction solution was kept at 10 to 11.

After the dropwise addition was completed, the reaction system was further stirred at a temperature of 50° C. for 6 hours. The reaction system was then allowed to cool to room temperature. 60.8 g (0.600 mol) of concentrated hydrochloric acid was added to the reaction system. The resulting solid was filtered off, and then recrystallized from water. The resulting white solid was then dried under reduced pressure to obtain 54.2 g (0.213 mol) of the desired compound. (Yield: 71%; m.p. 230°-232° C. (decomposition))

Elementary analysis Calculated % : H 5.55, C 33.07, N 11.02, S 12.61; Found %: H 5.52, C 32.78, N 11.00, S 12.77.

$^1$HNMR ($D_2O$) δppm: δ2.65 (t 2H); δ2.76 (s 3H); δ3.00 (t 2H); δ3.19 (s 4H).

SYNTHESIS EXAMPLE 2: Synthesis of Compound 3

15.0 g (0.20 mol) of glycine was dissolved in 40 ml (0.20 mol) of 5N sodium hydroxide. While the solution was stirred at a temperature of 50° C, 66.2 g (0.42 mol) of 2-chloroethylmethanesulfonamide and 84 ml (0.42 mol) of 5N sodium hydroxide were slowly added dropwise to the solution in such a manner that the pH value of the reaction solution was kept at 10 to 11.

After the dropwise addition was completed, the reaction system was further stirred at a temperature of 50° C. for 5 hours. The reaction system was then allowed to cool to room temperature. 20.3 g (0.20 mol) of concentrated hydrochloric acid was added to the reaction system. The resulting solid was filtered off, and then recrystallized from water. The resulting white solid was then dried under reduced pressure to obtain 20.6 g (0.0649 mol) of the desired compound. (Yield: 32%; m.p. 176°-177° C. (decomposition))

Elementary analysis: Calculated % : H 6.03, C 30.28, N 13.24, S 20.21; Found %: H 6.00, C 30.17, N 13.32, S 20.29.

$^1$HNMR ($D_2O$) δppm: δ3.13 (s 6H); δ3.54 (s 4H); δ3.58 (t 4H); δ3.90 (s 2H).

SYNTHESIS EXAMPLE 3: Synthesis of Compound 7

36.5 g (0.207 mol) of ethylenediamine N,N'-diacetate was dissolved in 82.8 ml (0.414 mol) of 5N sodium hydroxide. While the solution was stirred at a temperature of 50° C., 71.7 g (0.455 mol) of 2-chloroethylmethanesulfonamide and 91.0 ml (0.455 mol) of 5N sodium hydroxide were slowly added dropwise to the solution in such a manner that the pH value of the reaction solution was kept at 10 to 11.

After the dropwise addition was completed, the reaction system was further stirred at a temperature of 50° C. for 3 hours. The reaction system was then allowed to cool to room temperature. 46.1 g (0.455 mol) of concentrated hydrochloric acid was added to the reaction system. Sodium chloride thus deposited was filtered off. 46.1 g (0.455 mol) of concentrated hydrochloric acid was then added to the filtrate. The reaction solution was then concentrated to about 50 ml under reduced pressure. Sodium chloride thus deposited was filtered off. This procedure was further repeated twice. Methanol was then added to the reaction system. The resulting solid was filtered off, and then dried under reduced pressure to obtain 23.1 g (0.0462 mol) of Compound 7 in the form of ½ hydrate of dihydrochloride. (Yield: 22%; m.p. 189°-190° C. (decomposition))

Elementary analysis for $C_{12}H_{26}N_4O_8S_2 \cdot 2HCl \cdot \frac{1}{2}H_2O$: Calculated % : H 5.84, C 28.80, N 11.20, S 12.81, Cl 14.17; Found %: H 5.74, C 28.57, N 11.00, S 12.78, Cl 14.31.

$^1$HNMR ($D_2O$) δppm: δ3.13 (t 6H); δ3.47 (t 4H); δ3.55 (t 4H); δ3.68 (s 4H); δ4.08 (s 4H).

SYNTHESIS EXAMPLE 4: Synthesis of Compound 11

14.6 g (0.055 mol) of dihydrochloride N,N'-diacetic acid-1,3-propanediamine was dissolved in 44.4 ml (0.222 mol) of 5N sodium hydroxide. While the solution was stirred at a temperature of 50° C., 19.3 g (0.123 mol) of 2-chloroethylmethanesulfonamide and 24.6 ml (0.123 mol) of 5N sodium hydroxide were slowly added dropwise to the solution in such a manner that the pH value of the reaction solution was kept at 10 to 11.

After the dropwise addition was completed, the reaction system was further stirred at a temperature of 50° C. for 3 hours. The reaction system was then allowed to cool to room temperature. 90.0 g (0.889 mol) of concentrated hydrochloric acid was added to the reaction system. The reaction solution was then concentrated to about 50 ml under reduced pressure. The reaction solution was adjusted with potassium carbonate to a pH value of 6.0 and then allowed to stand overnight. The resulting solid was filtered off, and then recrystallized from water. The resulting white solid was then dried under reduced pressure to obtain 4.0 g ($8.54 \times 10^{-3}$ mol) of Compound 11 in the form of dihydrate. (Yield: 15%; m.p. 189°-190° C. (decomposition))

Elementary analysis for $C_{13}H_{28}N_4O_8S_2.2H_2O$: Calculated % : H 6.88, C 33.32, N 11.96, S 13.69; Found %: H 6.81, C 32.50, N 11.78, S 13.65.

$^1$HNMR ($D_2O$) δppm: δ1.56–1.75 (m 2H); δ2.58 (t 2H); δ2.69 (t 2H); δ2.75 (s 6H); δ3.01 (t 2H); δ3.18 (2 4H).

The compound represented by formula (I) can be applied to all processing compositions for the processing of silver halide photographic materials. Examples of such processing compositions include general purpose black-and-white developer, infectious developer for lithographic film, color developer, bleaching solution, blix solution, adjustor, stop solution, film hardener, washing solution, stabilizing solution, rinse solution, fogging solution, and toner. However, the present invention is not limited to these processing compositions.

The amount of the compound represented by formula (I) to be incorporated in the system depends on the processing composition in which it is incorporated and normally is in the range of 10 mg to 50 g per l of processing composition.

More particularly, if the compound represented by formula (I) is incorporated in a black-and-white developer or color developer, the amount of the compound to be incorporated is preferably in the range of 0.5 to 10 g, particularly 0.5 to 5 g, per l of processing solution. If the compound represented by formula (I) is incorporated in a bleaching solution (comprising, e.g., hydrogen peroxide, persulfuric acid, bromic acid), the amount of the compound to be incorporated is preferably in the range of 0.1 to 20 g, particularly 0.1 to 5 g, per l of bleaching solution. If the compound represented by formula (I) is incorporated in a fixing solution or blix solution, the amount of the compound to be incorporated is preferably in the range of 1 to 40 g, particularly 1 to 20 g, per l of processing solution. If the compound represented by formula (I) is incorporated in a stabilizing solution, the amount of the compound to be incorporated is preferably in the range of 50 mg to 1 g, particularly 50 to 300 mg, per l of stabilizing solution.

Compounds represented by formula (I) can be used, singly or in combination.

The compound represented by formula (I) can be in the form of metal chelate compound formed with a salt of metal selected from the group consisting of Fe(III), Mn(III), Co(III), Rh(II), Rh(III), Au(II), Au(III) and Ce(IV) to serve as bleaching agent for silver halide color photographic materials.

In accordance with an embodiment of a processing composition containing a metal chelate compound of the present invention, a silver halide color photographic material which has been imagewise exposed to light is color-developed, and then processed with a processing compound containing at least a metal chelate compound of the present invention, making it possible to bleach developed silver at an extremely rapid rate. Further, this inhibits remarkable bleach fog which has heretofore been caused by conventional bleaching agents which enable rapid bleach. These effects become remarkable particularly when a rapid color development which is effected in 3 minutes or less is followed by processing with a processing composition containing a metal chelate compound of the present invention. The processing composition of the present invention also provides an excellent image storability and exhibits a preferable handleability.

The metal salt which constitutes the metal chelate compound of the present invention is selected from the group consisting of Fe(III), Mn(III), Co(III), Rh(II) Rh(III), Au(II), Au(III), and Ce(IV). Preferably, the metal salt is Fe(III), Mn(III), or Ce(IV), and Fe(III) is particularly preferred.

The metal chelate compound of the present invention may be formed by reacting the compound of formula (I) with a metal salt such as ferric sulfate, ferric chloride, ferric nitrate, ammonium iron(III) sulfate or ferric phosphate in a solution, and then used as such. The compound of formula (I) is used in an amount at least 1.0 mol per mol of the metal ion. When the stability of the metal chelate compound is low, it is preferred that the ratio by mol of the compound to the metal ion is higher. Generally, the ratio is in the range of 1/1 to 30/1.

The metal chelate compound of the present invention may be isolated and used.

Examples of the metal chelate compound include, but are not limited to, the following compounds.

4C

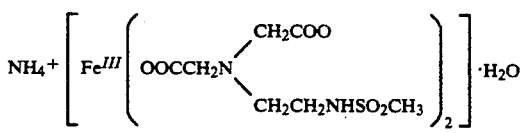

7C

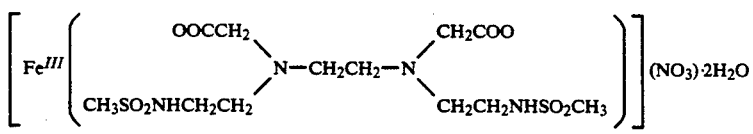

8C

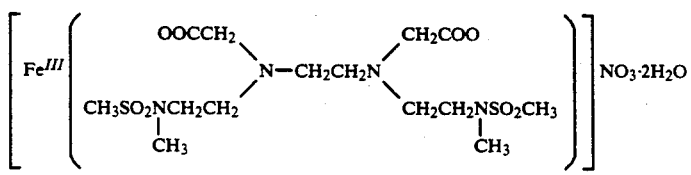

-continued

11C

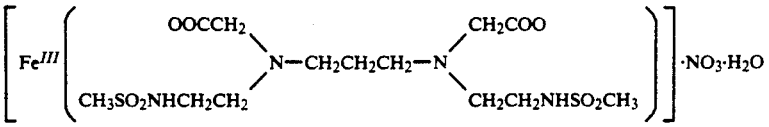

12C

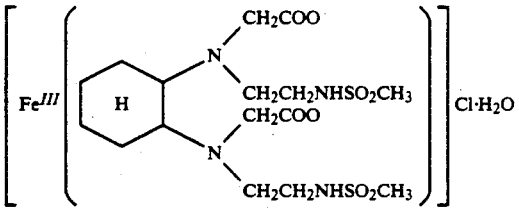

13C

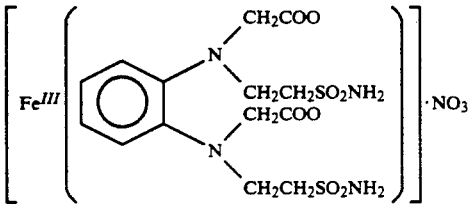

26C

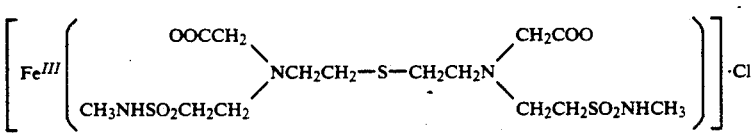

SYNTHESIS EXAMPLE 5: Synthesis of Compound 7C 6.01 g (0.012 mol) of Compound 7 in the form of ½ hydrate of dihydro chloride and 4.04 g (0.01 mol) of iron (III) nitrate nonahydrate were dissolved in 30 ml of water, followed by adjusting the pH of the solution to about 2.5 with acetic acid and aqueous ammonia. The solution was then filtered with a glass filter and allowed to stand at room temperature to gradually evaporate water. The resulting precipitate was filtered off, washed with cold water, and then dried under reduced pressure to obtain 1.94 g ($3.40\times10^{-3}$ mol) of Compound 7C. (Yield: 34%; m.p. higher than 260° C. (decomposition))

Elementary analysis for $C_{12}H_{24}N_4O_8S_2.NO_3.2H_2O$: Calculated %: H 4.95, C 25.27, N 12.28, S 11.24; Found %: H 5.02, C 25.18, N 12.12, S 11.18.

The metal chelate compound is effective as a bleaching agent for the bleaching solution or the blixing solution when 0.01 to 1 mol of the metal chelate compound per liter of the processing solution is used. A small amount of the metal chelate compound of the present invention may also be contained in a fixing solution or intermediate baths (e.g., bleaching acceleration bath, compensating bath) between color development and the desilverization stage.

A preferred embodiment of the processing solution having bleaching ability (used as a general term for a bleaching solution or a blixing solution) is illustrated below.

When 0.01 to 1 mol of the metal chelate compound of the present invention per liter of the processing solution having bleaching ability is contained in the processing solution, the metal chelate compound is effective as a bleaching agent as described above. More preferably 0.05 to 0.5 mol, most preferably 0.1 to 0.5 mol, of the metal chelate compound per liter of the processing solution is used.

When the metal chelate compound of the present invention is used as a bleaching agent in the processing solution having bleaching ability, other conventional bleaching agents may be used in combination in an amount within which the effect of the present invention can be obtained. Examples of such bleaching agents include Fe(III), Co(III) or Mn(III) chelate bleaching agents of compounds described below, persulfates (e.g., peroxodisulfates), hydrogen peroxide and bromates.

Examples of compounds which form the above-described chelate bleaching agents include, but are not limited to, ethylenediaminetetraacetic acid, disodium ethylenediaminetetraacetate, diammonium ethylenediaminetetraacetate, tetra(trimethylammonium) ethylenediaminetetraacetate, tetrapotassium ethylenediaminetetraacetate, tetrasodium ethylenediaminetetraacetate, trisodium ethylenediaminetetraacetate, diethylenetriaminepentaacetic acid, pentasodium diethylenetriaminepentaacetate, ethylenediamine-N-(β-oxyethyl)-N,N',N'-triacetic acid, trisodium ethylenediamine-N-(β-oxyethyl)-N,N',N'-triacetate, triammonium ethylenediamine-N-(β-oxyethyl)-N,N',N'-triacetate, 1,2-diaminopropanetetraacetic acid, disodium 1,2-diaminopropanetetraacetate, 1,3-diaminopropanetetraacetic acid, diammonium 1,3-diaminopropanetetraacetate, nitrilotriacetic acid, trisodium nitrilotriacetate, cyclohexanediaminetetraacetic acid, disodium cyclohexanediaminetetraacetate, iminodiacetic acid, dihydroxyethylglycine, ethyl ether diaminetetraacetic acid, glycol ether diaminetetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid and 1,3-propylenediamine-N,N,N',N'-tetramethylenephosphonic acid.

It is preferred that a halide such as a chloride, a bromide or an iodide as a re-halogenating agent for accelerating the oxidation of silver is added to the processing solution having a bleaching ability which contains the metal chelate compound of the present invention as a bleaching agent. Alternatively, an organic ligand capable of forming a slightly soluble silver salt may be added in place of the halide. The halide is added in the form of an alkali metal salt, an ammonium salt or a salt of guanidine or an amine. Examples of the halide include sodium bromide, ammonium bromide, potassium chloride and guanidine hydrochloride. Ammonium bromide is preferable. The re-halogenating agent is used in an amount of 0.1 to 2.0 mol, preferably 0.3 to 1.7 mol per liter of the bleaching solution.

The blixing solution containing the metal chelate compound of the present invention also contains a fixing agent (described hereinafter) and can optionally contain said re-halogenating agent. The re-halogenating agent is used in an amount of 0.001 to 2.0 mol/l, preferably 0.001 to 1.0 mol/l in the blixing solution.

Further, a bleaching accelerator, a corrosion inhibitor for preventing processing bath from being corroded, a buffering agent for keeping the pH of the solution, a fluorescent brightener, an anti-foaming agent, etc. are optionally added to the bleaching solution or the blixing solution of the present invention.

Examples of the bleaching accelerator which can be used in the present invention include compounds having a mercapto group or a disulfide group described in U.S. Pat. No. 3,893,858, German Patent 1,290,812, U.S. Pat. No. 1,138,842, JP-A-53-95630 and *Research Disclosure* No. 17129 (1978); thiazolidine derivatives described in JP-A-50-140129; thiourea derivatives described in U.S. Pat. No. 3,706,561; polyethylene oxides described in German Patent 2,748,430; polyamine compounds described in JP-B-45-8836 (the term "JP-B" as used herein means an "examined Japanese patent publication"); and imidazole compounds described in JP-A-49-40493. Of these, mercapto compounds described in U.S. Pat. No. 1,138,842 are preferred.

Nitrates are preferred as the corrosion inhibitor (for example, ammonium nitrate and potassium nitrate). The amount of the corrosion inhibitor added is 0.05 to 0.5 mol/l, preferably 0.01 to 2.0 mol/l, more preferably 0.05 to 0.5 mol/l.

The pH of the bleaching solution or the blixing solution of the present invention is 2.0 to 8.0, preferably 3.0 to 7.5. When bleaching or blixing is carried out immediately after color development, the pH of the solution is not higher than 7.0, preferably not higher than 6.4 to prevent bleach fog. In the case of the bleaching solution, the pH is particularly preferably 3.0 to 5.0. When the pH is less than 2.0, the metal chelate compound of the present invention is unstable. Hence, the pH is preferably in the range of 2.0 to 6.4. In processing of color print materials, the pH is preferably 3 to 7.

Any pH buffering agents can be used, produced they are difficult to be oxidized by bleaching agents and have a buffering effect in the above-described pH range. Examples of the buffering agents include organic acids such as acetic acid, glycolic acid, lactic acid, propionic acid, butyric acid, malic acid, chloroacetic acid, levulinic acid and ureidopropionic acid, and organic bases such as pyridine, dimethylpyrazole, 2-methyl-o-oxazoline and aminoacetonitrile. They may be used in dependenthy or as admixture of two or more. Of these, organic acids having a pKa of 2.0 to 5.5 are preferred, and acetic acid and glycolic acid are particularly preferably used independently or as a mixture thereof. The buffering agents are used in an amount of 0 to 3.0 mol/l, preferably 0.5 to 2.0 mol/l.

If desired, the above-described acid may be used together with an alkali agent (e.g., ammonia water, KOH, NaOH, imidazole, monoethanolamine, diethanolamine) to adjust the pH of the processing solution having a bleaching ability to a value in the above-described range. Of these, ammonia water is preferable.

It is preferred that when processing is conducted, the processing solution having a bleaching ability is aerated to oxidize the formed iron (II) complex salt, whereby the bleaching agent is regenerated and photographic performance can be kept stable.

The bleaching stage or the blixing stage can be conducted at a temperature of 30° to 60° C., preferably 35° to 50° C.

The time of the bleaching stage and/or the blixing stage is from 10 seconds to 7 minutes, preferably from 10 seconds to 2 minutes when photographic materials for photographing are processed. The time is from 5 to 70 seconds, preferably 5 to 60 seconds, more preferably 10 to 45 seconds when photographic materials for print are processed. When processing is carried out under these preferred conditions, good results are obtained in that processing is rapid and staining is not increased.

Conventional fixing agents can be used in the fixing solution or the blixing solution. Examples of the fixing agents include thiosulfates, thiocyanates, thioethers, amines, mercapto compounds, thiones, thioureas, iodides and meso-ions. More specifically, examples of the fixing agents include ammonium thiosulfate, sodium thiosulfate, potassium thiosulfate, guanidine thiosulfate, potassium thiocyanate, dihydroxyethyl thioether, 3,6-dithia-1,8-octanediol and imidazole. Of these, thiosulfates, particularly ammonium thiosulfate are preferred for rapid fixing. If desired, two or more fixing agents may be used in combination to conduct more rapid fixing. For example, a combination of ammonium thiosulfate with ammonium thiocyanate, imidazole, thiourea or thioether can be used. The second fixing agent is preferably used in an amount of 0.01 to 100 mol % based on the amount of ammonium thiosulfate.

The fixing agents are used in an amount of 0.2 to 3.0 mol, preferably 0.5 to 2.0 mol per liter of the fixing solution or the blixing solution. The pH of the fixing solution varies depending on the types of the fixing agents, but is generally 3.0 to 9.0. Particularly, when thiosulfates are used, a pH of 6.5 to 8.0 is preferred for stable fixing performance.

A preservative can be added to the fixing solution and/or the blixing solution to enhance the stability of the solution with time. When the fixing solution or the blixing solution contains a thiosulfate, sulfites and/or hydroxylamine, hydrazine and bisulfite addition products of aldehydes (e.g., bisulfite addition product of acetaldehyde, particularly preferably bisulfite addition products of aromatic aldehydes described in JP-A-1-298935) are effective as preservatives. Further, sulfinic acid compounds described in JP-A-62-143048 can be preferably used.

Preferably a buffering agent is added to the fixing solution and/or the blixing solution to keep the pH of the solution constant. Examples of the buffering agent include phosphates, imidazole compounds such as imidazole, 1-methylimidazole, 2-methylimidazole and 1-ethylimidazole, triethanolamine, N-allylmorpholine and N-benzoylpiperazine. Further, various chelating agents can be added to the fixing solution to sequester iron ion brought over from the bleaching solution, whereby the stability of the solution can be improved. Examples of such chelating agents which can be preferably used include, other than the compounds of formula (I) of the present invention, 1-hydroxyethylidene-1,1-diphosphonic acid, ethylenediamine-N,N,N',N'-tetramethylenephosphonic acid, nitrilotrimethylenephosphonic acid, ehylenediaminetetraacetic acid, diethylenetriaminepentaacetic acid, cyclohexanediaminetetraacetic acid and 1,2-propanediaminetetraacetic acid.

The fixing stage is carried out at a temperature of 30° to 60° C., preferably 35° to 50° C.

The time of the fixing stage is from 15 seconds to 2 minutes, preferably 25 to 100 seconds when photographic materials for photographing are processed. The time is from 8 to 80 seconds, preferably 10 to 45 seconds when photographic materials for prints are processed.

The desilvering stage of the present invention is carried out by a combination of the bleaching stage, the fixing stage and the blixing stage. Typical examples of suitable combinations and orders include the following cases.

(1) The bleaching stage—the fixing stage (2) The bleaching stage—the blixing stage (3) The bleaching stage—the blixing stage—the fixing stage (4) The bleaching stage—rinse stage—the fixing stage (5) The blixing stage (6) The fixing stage—the blixing stage When photographic materials for photographing are processed, combinations (1), (2), (3) and (4) are preferred with (1), (2) or (3) being more preferred. When photographic materials for prints are processed, combination (5) is preferred.

The present invention can be applied to the desilvering treatment through a stop bath, a rinsing bath, etc. after color development.

It is preferred that stirring is vigorously conducted as much as possible in the desilvering stage such as bleaching, blixing, fixing stages, etc. of the present invention, to better attain the effect of the present invention.

Methods for increasing stirring power include a method wherein a jet stream of the processing solution is allowed to collide with the emulsion surfaces of the photographic materials as described in JP-A-62-183460 and JP-A-62-183461; a method wherein stirring effect is enhanced by using a rotating means as described in JP-A-62-183461; a method wherein a wiper blade provided in the solution is brought into contact with the emulsion surfaces and during such time the photographic materials are transferred, whereby a turbulent flow is caused on the surfaces of the emulsions; and a method wherein the entire circulating flow rate of the processing solution is increased. Such means for improving stirring are effective in stirring any of the bleaching solution, the blixing solution and the fixing solution. It is believed that an improvement in stirring can increase the delivery rate of the bleaching agent and the fixing agent into the emulsion layers and as a result, desilvering speed can be increased.

The above-described means for improving stirring are more effective when bleaching accelerators are used. By using the improved stirring method, the bleaching acceleration effect can be greatly increased, and a problem with regard to the interference of the bleaching accelerators with fixing can be solved.

The above-described vigorous stirring can be preferably used in color developing solutions, rinsing solutions and stabilizing solutions.

It is preferred that the processing method of the present invention is carried out by using automatic processors. Conveying methods in the automatic processors are described in JP-A-60-191257, JP-A-60-191258 and JP-A-60-191259. It is preferred that crossover time between processing tanks in the automatic processors is short to allow for rapid processing. An automatic processor in which cross-over time is not longer than 5 seconds is described in JP-A-1-319038.

It is preferred that when continuous processing is carried out using automatic processors in accordance with the processing method of the present invention, a replenisher in an amount corresponding to the amount of the photographic material processed is added to make up for a loss of ingredients in the processing solution consumed by processing the photographic material and to inhibit the accumulation of undesirable ingredients in the processing solution which are dissolved out of the photographic material. Two or more processing bath tanks may be provided in each processing stage. In this case, a countercurrent system in which the replenisher is allowed to flow from the backward bath into the forward bath is preferable. A two to four-step cascade is preferable in the rinsing stage and stabilization stage in particular.

It is desirable to reduce the amount of replenisher, provided that a change in the composition of each processing solution does not have an adverse effect on photographic performance or cause the staining of other solutions.

The amount of the replenisher for the color developing solution is 100 to 3000 ml, preferably 100 to 2200 ml per $m^2$ of the photographic material when color photographic materials for photographing are processed. The amount of the replenisher is 20 to 500 ml, preferably 30 to 350 ml per $m^2$ of the photographic material when color photographic materials for color prints are processed.

The amount of replenisher for the bleaching solution is 10 to 1000 ml, preferably 50 to 550 ml per $m^2$ of the photographic material when color photographic materials for photography are processed. The amount is 20 to 500 ml, preferably 50 to 300 ml per $m^2$ of the photographic material when color photographic materials for prints are processed.

In the case of the blixing solution, the amount of replenisher is 200 to 3000 ml, preferably 250 to 1300 ml per $m^2$ of the photographic material when color photographic materials for photographing are processed. The amount of the replenisher is 20 to 300 ml, preferably 50 to 200 ml when photographic materials for prints are processed. The replenishment of the blixing solution may be made by a single solution or by separately adding a bleaching composition and a fixing composition. Alternatively, overflow solutions from the bleaching bath and/or the fixing bath may be mixed to form the replenisher of the blixing solution.

In the case of the fixing solution, the amount of the replenisher is 300 to 3000 ml, preferably 300 to 1200 ml per $m^2$ of the photographic material when color photographic materials for photography are processed. The amount of the replenisher is 20 to 300 ml, preferably 50 to 200 ml per $m^2$ of the photographic material when photographic materials for prints are processed.

The replenishment rate per unit area of rinsing water or stabilizing solution is 1 to 50 times, preferably 2 to 30 times, more preferably 2 to 15 times the amount carried over from the pre-bath.

It is preferred that various regenerating methods are combined to further reduce the amounts of replenishers from the viewpoint of the preservation of the environment. Regeneration may be conducted while the processing solutions are circulated in the automatic processors. Alternatively, regeneration may be conducted by removing the processing solutions from the processing tanks, subjecting the solutions to suitable regeneration treatment and returning the regenerated solutions as replenishers to the processing tanks.

The developing solutions can be regenerated by performing an ion exchange treatment with anion exchange resins, removing the accumulated materials with electrodialysis treatment and adding a reagent known as a regenerant. The regeneration ratio is preferably not lower than 50%, more preferably not lower than 70%. Commercially available anion exchange resins can be used, but the high-selective ion exchangers described in JP-A-63-11005 are preferred.

The metal chelate bleaching agent in the bleaching solution and/or the blixing solution is reduced during bleaching. When the reduced metal chelate compound is accumulated, bleaching performance is lowered and sometimes image dye becomes leuco dye. As a result, image density is lowered. Hence, it is preferred that the bleaching solution and/or the blixing solution are/is continuously regenerated in connection with processing. Specifically, air is blown into the bleaching solution and/or the blixing solution by means of an air pump, and the reduced metal chelate compound is re-oxidized by oxygen, that is, the solutions are aerated. In another embodiment, regeneration can be carried out by adding oxidizing agents such as hydrogen peroxide, persulfates and bromates.

The regeneration of the fixing solution and the blixing solution can be made by electrolytically reducing accumulated silver ion. The removal of accumulated halogen ion with anion exchange resins is preferred for retaining fixing performance.

The amount of rinsing water used can be reduced by means of ion exchange resins or ultrafiltration. The use of ultrafiltration is preferable.

Color developing solutions which are used in the present invention contain conventional aromatic primary amine color developing agents. Preferred examples of the color developing agents include p-phenylenediamine derivatives. Typical examples of the p-phenylenediamine derivatives include, but are not limited to, the following compounds.

D-1: N,N-Diethyl-p-phenylenediamine

D-2: 4-Amino-N,N-diethyl-3-methylaniline

D-3: 4-Amino-N-(δ-hydroxyethyl)-N-methylaniline

D-4: 4-Amino-N-ethyl-N-(δ-hydroxyethyl)-aniline

D-5: 4-Amino-N-ethyl-N-(δ-hydroxyethyl)-3-methylaniline

D-6: 4-Amino-N-ethyl-N-(3-hydroxypropyl)-3-methylaniline

D-7: 4-Amino-N-ethyl-N-(4-hydroxybutyl)-3-methylaniline

D-8: 4-Amino-N-ethyl-N-(δ-methanesulfonamidoethyl)-3-methylaniline

D-9: 4-Amino-N,N-diethyl-3-(δ-hydroxyethyl)aniline

D-10: 4-Amino-N-ethyl-N-(δ-methoxyethyl)-3-methylaniline

D-11: 4-Amino-N-(δ-ethoxyethyl)-N-ethyl-3-methylaniline

D-12: 4-Amino-N-(3-carbamoylpropyl)-N-n-propyl-3-methylaniline

D-13: 4-Amino-N-(4-carbamoylbutyl)-N-n-propyl-3-methylaniline

D-14: N-(4-Amino-3-methylphenyl)-3-hydroxy-pyrrolidine

D-15: N-(4-Amino-3-methylphenyl)-3-(hydroxymethyl)-pyrrolidine

D-16: N-(4-Amino-3-methylphenyl)-3-pyrrolidinecarboxamide

D-17: 4-Amino-N-ethyl-N-(δ-hydroxyethyl)-3-methoxyaniline

Of the above-described p-phenylenediamine derivatives, compounds D-5, D-6, D-7, D-8, D-12 and D-17 are particularly preferred. These p-phenylenediamine derivatives may be in the form of a salt such as sulfate, hydrochloride, sulfite, naphthalenedisulfonate or p-toluenesulfonate. The aromatic primary amine developing agents are preferably used in an amount of 0.0002 to 0.2 mol, more preferably 0.001 to 0.1 mol per one liter of the developing solution.

Sulfites such as sodium sulfite, potassium sulfite, sodium bisulfite, potassium bisulfite, sodium metabisulfite and potassium metabisulfite and carbonylsulfite adduct as preservatives can be optionally added to the color developing solutions.

Further, compounds which directly preserve the aromatic primary amine color developing agents can be added, such as hydroxylamines, particularly those having a sulfo group or a carboxyl group described in JP-A-63-5341 and JP-A-63-106655, hydroxamic acids described in JP-A-63-43138, hydrazines and hydrazides described in JP-A-63-146041, phenols described in JP-A-63-44657 and JP-A-63-58443, α-hydroxyketones and α-aminoketones described in JP-A-63-44656 and/or saccharide described in JP-A-63-36244. Further, it is preferred that monoamines described in JP-A-63-4235, JP-A-63-24254, JP-A-63-21647, JP-A-63-146040, JP-A-63-27841 and JP-A-63-25654, diamines described in JP-A-63-30845, JP-A-63-14640 and JP-A-63-43139, polyamines described in JP-A-63-21647, JP-A-63-26655 and JP-A-63-44655, nitroxy radicals described in JP-A-63-53551, alcohols described in JP-A-63-43140 and JP-A-63-53549, oximes described in JP-A-63-56654 and tertiary amines described in JP-A-63-239447 are used in combination with the aforesaid compounds.

Other preservatives which may be optionally used include various metals described in JP-A-57-44148 and JP-A-57-53749, salicylic acids described in JP-A-59-180588, alkanolamines described in JP-A-54-3582, polyethyleneimines described in JP-A-56-94349 and aromatic polyhydroxy compounds described in U.S. Pat. No. 3,746,544. Of these, the aromatic polyhydroxy compounds are preferable.

These preservatives are used in an amount of 0.005 to 0.2 mol, preferably 0.01 to 0.05 mol per liter of the color developing solution.

The pH of the color developing solutions used in the present invention is in the range of 9.0 to 12.0, preferably 9.5 to 11.5. The color developing solutions may contain compounds which are conventionally contained in developing solutions.

It is preferred that various buffering agents are used to keep the pH in the above range. Examples of the buffering agents include sodium carbonate, potassium carbonate, sodium bicarbonate, potassium bicarbonate, trisodium phosphate, tripotassium phosphate, disodium hydrogenphosphate, dipotassium hydrogenphosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-o-hydroxybenzoate (potassium 5-sulfosalicylate). However, the buffering agents which can be used in the present invention are not limited to the above compounds.

The buffering agents are preferably used in an amount of at least 0.1 mol, particularly preferably 0.1 to 0.4 mol per liter of the color developing solution.

The color developing solutions may contain various chelating agents, other than those of formula (I) of the present invention, as suspending agents for calcium and magnesium or to improve the stability of the color developing solutions.

As the chelating agents, organic acid compounds such as aminopolycarboxylic acids, organic phosphonic acids and phosphonocarboxylic acids are preferred. Examples thereof include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid and N,N'-bis(2-hydroxy benzyl)ethylenediamine-N,N'-diacetic acid.

These chelating agents may be used either alone or in a combination of two or more.

These chelating agents may be used in an amount sufficient to sequester metal ions in the color developing solutions. The amount of the chelating agent added is generally 0.001 to 0.5 mol, preferably 0.003 to 0.02 mol per liter of the color developing solution.

The color developing solutions may optionally contain development accelerators.

Examples of the development accelerators include thioether compounds described in JP-B-37-16088, JP-B-37- 5987, JP-B-38-7826, JP-B-44-12380, JP-B-45-9019 and U.S. Pat. No. 3,818,247, p-phenylenediamine compounds described in JP-A-52-49829 and JP-A-50-15554, quaternary ammonium salts described in JP-A-50-137726, JP-B-44-30074, JP-A-56-156826 and JP-A-52-43429, amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346, polyalkylene oxides described in JP-B-37-16086, JP-B-42-25201, U.S. Pat. No. 3,128,183, JP-B-41-11431, JP-B-42-23883 and U.S. Pat. No. 3,532,501 and imidazole compounds such as 2-methylimidazole and imidazole.

It is preferred that 1-phenyl-3-pyrazolidones are added as auxiliary developing agents to carry out rapid development. Examples of the 1-phenyl-3-pyrazolidones include the following compounds.

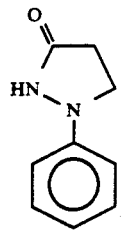
AD-1

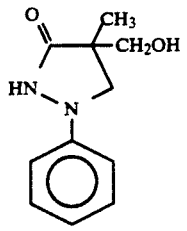
AD-2

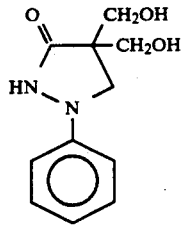
AD-3

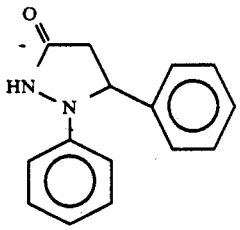
AD-4

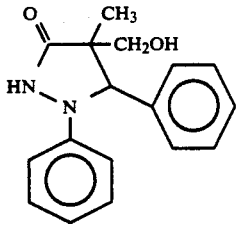
AD-5

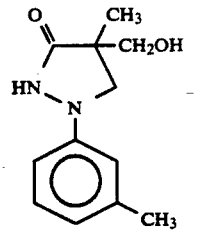
AD-6

These auxiliary developing agents are used in an amount of 0.0005 to 0.03 mol, preferably 0.001 to 0.01 mol per liter of the color developing solution.

Anti-fogging agents may be optionally added to the color developing solutions which are used in the present invention. Antifogging agents which can be used include alkali metal halides such as sodium chloride, potassium chloride and potassium iodide and organic antifogging agents. Typical examples of the organic antifogging agents include nitrogen-containing heterocyclic compounds such as benztriazole, 6-nitrobenzimidazole, 5-nitroisoindazole, 5-methylbenztriazole, 5-nitrobenztriazole, 5-chlorobenztriazole, 2-thiazolylbenzimidazole, 2-thiazolylmethylbenzimidazole, indazole, hydroxyazaindolizine and adenine.

The color developing solutions which are used in the present invention may contain fluorescent brighteners. Preferred fluorescent brighteners are 4,4'-diamino-2,2'-disulfostilbene compounds. The fluorescent brighteners are used in an amount of 0 to 5 g/l, preferably 0.1 to 4 g/l.

If desired, various surfactants such as alkylsulfonic acids, arylsulfonic acids, aliphatic carboxylic acids and aromatic carboxylic acids may be added.

Processing temperature using the color developing solutions in the present invention is 20° to 55° C., preferably 30° to 55° C. Processing time is from 20 seconds to 5 minutes, preferably from 30 seconds to 3½ minutes, more preferably from one minute to 2½ minutes for photographic materials for photography, and it is from 10 seconds to 1½ minutes, preferably from 10 seconds to one minute, more preferably 10 seconds to 40 seconds for photographic materials for prints.

The processing method of the present invention can be applied to reversal color development. The black-and-white developing solution used in this processing method are black-and-white first developing solutions conventionally used in the reversal development of color photographic materials. The black-and-white first developing solutions used for reversal color photographic materials may contain various additives which are conventionally used in black-and-white developing solutions used as processing solutions for black-and-white silver halide photographic materials.

Examples of typical additives include developing agents such as 1-phenyl-3-pyrazolidone, p-methylaminophenol and hydroquinone, preservatives such as sulfites, accelerators comprising alkali such as sodium hydroxide, sodium carbonate and potassium carbonate, inorganic and organic inhibitors such as potassium bromide, 2-methylbenzimidazole and methylbenzthiazole, water softeners such as polyphosphates and development inhibitors comprising a very small amount of an iodide or a mercapto compound.

The processing method of the present invention basically comprises the color development stage and subsequent desilvering stage. It is preferred that a rinsing stage and/or a stabilizing stage subsequent to the above stages are/is provided. The compounds of formula (I) of the present invention are also effective when added in a rinsing water or stabilizing solution used in these stages.

Various surfactants can be contained in the rinsing water or stabilizing solution to prevent irregularity in water droplets from being formed during the drying of photographic materials after processing. Examples of such surfactants include polyethylene glycol type nonionic surfactants, polyhydric alcohol type nonionic surfactants, alkylbenzenesulfonate type anionic surfactants, higher alcohol sulfuric ester salt type anionic surfactants, alkylnaphthalenesulfonate type anionic surfactants, quaternary ammonium salt type cationic surfactants, amine salt type cationic surfactants, amino acid type amphoteric surfactants and betaine type amphoteric surfactants. However, the ionic surfactants maybe bonded to various ions introduced by processing and insoluble materials are formed. Accordingly, the use of the nonionic surfactants is preferred. Particularly, alkylphenol ethylene oxide adducts are preferred. Octyl-, nonyl-, dodecyl- and dinonylphenols are particularly preferred as alkylphenols. The amount of ethylene oxide to be added is preferably 8 to 14 mol. Further, silicone surfactants having a high anti-foaming effect are preferred.

Various antibacterial agents and antifungal agents can be contained in the rinsing water or stabilizing solution to prevent water dirt from being formed or to prevent mold from being grown on the photographic materials.

Examples of the antibacterial agents and the antifungal agents include thiazolylbenzimidazole compounds described in JP-A-57-157244 and JP-A-58-105145, isothiazolone compounds described in JP-A-54-27424 and JP-A-57-8542, chlorophenol compounds such as trichlorophenol, bromophenol compounds, organotin compounds, organozinc compounds, thiocyanic acid compounds, isothiocyanic acid compounds, acid amide compounds, diazine and triazine compounds, thiourea compounds, benztriazole alkylguanidine compounds, guaternary ammonium salts such as benzammonium chloride, antibiotic such as penicillin and general-purpose antifungal agents described in *J. Antibacterial Antifungal Agents,* Vol 11, No. 5, pp. 207–223 (1983). These agents may be used either alone or in a combination of two or more.

Various germicides described in JP-A-48-83820 can also be used in the rinsing water or stabilizing solution.

Further, it is preferred that various chelating agents are contained in the rinsing water or stabilizing solution as long as they do not adversely affect on the effect of the compounds of formula (I).

Preferred chelating agents include aminopolycarboxylic acids such as ethylenediaminetetraacetic acid and diethylenetriaminepentaacetic acid, organic phosphonic acids such as 1-hydroxyethylidene-1,1-diphosphonic acid and ethylenediamine-N,N,N',N'-tetramethylenephosphonic acid and maleic anhydride polymers described in European Patent 345172Al.

It is preferred that preservatives which can be contained in the fixing solution and the blixing solution are contained in the rinsing water.

Processing solutions for stabilizing dye image are used as stabilizing solutions in the stabilizing stage. For example, organic acids, solutions having a buffering effect at a pH of 3 to 6 and solutions containing an aldehyde (e.g., formalin or glutaraldehyde), hexahydrotriazine, hexamethylenetetramine or N-methylols can be used. Further, ammonium compounds such as ammonium chloride and ammonium sulfite, metal compounds such as Bi and Al compounds, fluorescent brighteners, hardening agents and alkanolamines described in U.S. Pat. No. 4,786,583 can be used if desired.

In the rinsing stage and the stabilizing stage, a multistage countercurrent system is preferred. The number of stages is preferably 2 to 4. The replenishment rate per unit area is 1 to 50 times, preferably 2 to 30 times, more preferably 2 to 15 times the amount carried over from the prebath.

Tap water can be used in the rinsing stage and stabilizing stage. However, it is preferable to use water which is deionized by ion exchange resins to reduce the concentrations of Ca and Mg to not higher than 5 mg/l and which is sterilized with halogen, ultraviolet light germicidal lamp, etc.

Tap water may be used to make up water lost by evaporation in the rinsing stage and the stabilizing stage. However, deionized water and sterilized water can be preferably used.

In the present invention, it is preferred that the bleaching solution and the blixing solution as well as other processing solutions are replenished with an appropriate amount of water or a correction solution or a replenisher to correct the concentration caused by evaporation.

Further, it is preferred that overflow solutions in the rinsing stage and the stabilizing stage are allowed to flow into a prebath having a fixing ability, because the amount of waste solution can be reduced.

Examples of photographic light-sensitive materials which can be processed with the processing composition of the present invention include ordinary black-and-white silver halide photographic materials (e.g., black-and-white light-sensitive material for picture taking, X-ray black-and-white light-sensitive material, black-and-white light-sensitive material for printing), ordinary multi-layer silver halide color photographic materials (e.g., color negative film, color reversal film, color positive film, color negative film for motion picture, color photographic paper, reversal color photographic paper, direct positive color photographic paper), infrared-sensitive light-sensitive materials for laser scanner, and diffusion transfer light-sensitive materials (e.g., silver diffusion transfer light-sensitive material, color diffusion transfer light-sensitive material).

The photographic light-sensitive material of the present invention may have various layer structures (e.g., silver halide emulsion layers having sensitivity to red, green and blue, respectively, subbing layer, antihalation layer, filter layer, interlayer, surface protective layer) or arrangements on one or both surfaces thereof depending on the purpose thereof.

No specific limitations are imposed on the support for photographic light-sensitive material of the present invention, coating method, kind of silver halide emulsion to be incorporated in silver halide emulsion layer and surface protective layer (e.g., silver bromoiodide, silver bromochloroiodide, silver bromide, silver bromochloride, silver chloride), its crystal form (e.g., cube, tablet, sphere), its grain size, its fluctuation coefficient, its crystal structure (e.g., core/shell structure, multiphase structure, uniform phase structure), its preparation method (e.g., single jet process, double jet process), binder (e.g., gelatin), film hardener, fog inhibitor, metal doping agent, silver halide solvent, thickening agent, emulsion precipitant, dimensional stabilizer, adhesion inhibitor, stabilizer, contamination inhibitor, dye image stabilizer, stain inhibitor, chemical sensitizer, spectral sensitizer, sensitivity improver, supersensitizer, nucleating agent, coupler (e.g., pivaloilacetoanilide type or benzoylacetoanilide type yellow coupler, 5-pyrazolone type or pyrazoloazole type magenta coupler, phenol type or naphthol type cyan coupler, DIR coupler, bleach accelerator-releasing type coupler, competing coupler, colored coupler), coupler dispersion method (e.g., oil-in-water dispersion method using high boiling solvent), plasticizer, antistatic agent, lubricant, coating aid, surface active agent, brightening agent, formalin scavenger, light scattering agent, matting agent, light absorbent, ultraviolet absorbent, filter dye, irradiation dye, development improver, delustering agent, preservatives (e.g., 2-phenoxyethanol), fungicides, etc. For example, reference can be made to *Product Licensing*, vol. 92, pp. 107–110 (Dec., 1971), and *Research Disclosure* Nos. 17643 (Dec., 1978), 18716 (Nov., 1979), and 307105 (Nov., 1989).

The photographic material suitable for use in the present invention may comprise on a support at least one silver halide emulsion layer selected from a blue-sensitive layer, a green-sensitive layer and a red-sensitive layer. There is no particular limitation with regard to the number of silver halide emulsion layers and non-sensitive layers and the order of layers. A typical example thereof is a silver halide photographic material having a light-sensitive layer comprising a plurality of silver halide emulsion layers having substantially the same color sensitivity, but different light sensitivity. The light-sensitive layer is a unit light-sensitive layer having color sensitivity to any one of blue light, green light and red light.

In a multi-layer silver halide color photographic material, the unit light-sensitive layer is generally arranged in order of a red-sensitive layer, a green-sensitive layer and a blue-sensitive layer from the side of the support. However, the layers may be arranged in the reverse order to that described above, or the arrangement is such that a layer having different color sensitivity is interposed between layers having the same color sensitivity.

Non-sensitive layers such as interlayers may be provided between the silver halide sensitive layers, or between the uppermost layer and the lowermost layer.

The interlayers may contain couplers and DIR compounds described in JP-A-61-43748, JP-A-59-113438, JP-A-59-113440, JP-A-61-20037 and JP-A-61-20038, and conventional color mixing inhibitors, ultraviolet light absorbers and anti-staining agents.

A plurality of silver halide emulsion layers which constitute each unit light-sensitive layer preferably comprise a two-layer structure composed of a high-sensitivity emulsion layer and a low-sensitivity emulsion layer. Generally, it is preferred that the layer is so arranged that light sensitivity is lower toward the support. A non-sensitive layer may be provided between the silver halide emulsion layers. The low-sensitivity emulsion layer may be provided on the side which is farther away from the support, and the high-sensitivity emulsion layer may be provided on the side nearer the support as described in JP-A-57-112751, JP-A-62-200350, JP-A-62-206541 and JP-A-62-206543.

For example, the layers can be arranged in the order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), in the order of BH/BL/GL/GH/RH/RL or in the order of BH/BL/GH/GL/RL/RH from the side which is farthest away from the support.

The layers can be arranged in the order of blue-sensitive layer/GH/RH/GL/RL from the side farthest away from the support as described in JP-B-55-34932. The arrangement may be made in the order of blue-sensitive layer/GL/RL/GH/RH from the side farthest away from the support as described in JP-A-56-25738 and JP-A-62-63936. Further, a three-layer structure composed of three layers having different light sensitivities may be used, in which the layers are arranged so that the upper layer is a silver halide emulsion layer having the highest light sensitivity, the intermediate layer is a silver halide emulsion layer having light sensitivity lower than that of the upper layer and the lower layer is a silver halide emulsion layer having light sensitivity lower than that of the intermediate layer, and thus light sensitivity is lower toward the support as described in JP-B-49-15495. Even when such a three-layer structure composed of three layers having different light sensitivities is used, the arrangement may be made in order of medium-sensitivity emulsion layer/high-sensitivity emulsion layer/low-sensitivity emulsion layer in the same color-sensitive layer from the side farther away from the support as described in JP-A-59-202464.

Various layer structures and arrangement can be chosen according to the purpose or use of the photographic materials as described above.

Any of the above layer arrangements can be applied to the color photographic materials of the present invention. However, it is preferred from the viewpoint of achieving the objects of the present invention that the dry thickness of the entire constituent layers of the color photographic material excluding the support, the undercoat layer of the support and the back layer is preferably not more than 20.0μ, more preferably not more than 18.0μ when color photographic materials for photography are used. The dry thickness is preferably not more than 16.0 μm, more preferably not more than 13.0μ when photographic materials for prints are used. If the layer thickness is outside the range described above, bleach fog and stain formed during storage of an image after processing tend to occur due to the color developing agent left behind. In the formation of bleach fog and stain, an increase in magenta color presumably due to the green-sensitive layer is remarkable in comparison with an increase in cyan color and yellow color.

It is desirable that the lower limit of the layer thickness is reduced to a level which does not greatly damage the performance of the photographic material. The lower limit of the entire dry thickness of the constituent layers of the photographic material excluding the support and the undercoat layer of the support is 12.0μ in the case of photographing materials. The lower limit is 7.0μ in the case of photographing materials for prints.

In the case of photographic materials for photography, a layer such as an antihalation layer and an interlayer is generally provided between a light-sensitive layer nearest the support and the undercoat layer of the support. The lower limit of the total dry thickness of such a layer (or a plurality of layers) is 1.0μ.

With regard to the reduction of the layer thickness, the thicknesses of any of the light-sensitive layers and non-sensitive layers may be reduced.

The layer thickness of the multi-layer color photographic material of the present invention is measured in the following manner.

The photographic material to be measured is stored at 25° C. and 50% RH for 7 days after the preparation thereof. First, the overall thickness of the photographic material is measured. The coated layers on the support are removed, and the thickness of the remainder is then measured. The difference represents the thickness of the entire coated layers of the photographic material excluding the support. The thickness can be measured, for example, by using a layer thickness measuring device using a contact type piezoelectric transduction element (K-402B Stand. manufactured by Anritsu Electric Co., Ltd.). The removal of the coated layers on the support can be made by using an aqueous solution of sodium hypochlorite.

Subsequently, a sectional photograph of the photographic material is taken (preferably at least 3,000× magnification) by using a scanning type electron microscope. The overall thickness of the support and the thickness of each layer are measured. The thickness of each layer can be calculated by comparing these measurements with the measured value (absolute value of measured value) of the overall thickness measured by the above layer thickness measuring device.

The swelling ratio [((equilibrium swollen layer thickness in $H_2O$ at 25° C.—the overall dry layer thickness at 25° C. 55% RH)/the overall dry layer thickness at 25° C. 55% RH)×100] of the photographic material of the present invention is preferably 50 to 200%, more preferably 70 to 150%. When the swelling ratio is outside the range described above, the amount of the color developing agent left behind is increased, and photographic performance, image quality such as desilverizability and layer physical properties such as layer strength are adversely affected.

The swelling rate $T_{\frac{1}{2}}$ of the photographic material of the present invention is preferably not longer than 15 seconds, more preferably not longer than 9 seconds. The swelling rate $T_{178}$ is defined as the time elapsed until the swollen layer thickness reaches ½ of the saturated swollen thickness when 90% of the maximum swollen layer thickness in a color developing solution (30° C., 3¼ minutes) represents saturated swollen layer thickness.

Silver halide contained in the photographic emulsion layers of the color photographic materials of the present invention may have any silver halide composition. For example, silver chloride, silver bromide, silver chlorobromide, silver iodobromide, silver iodochloride and silver iodochlorobromide can be used.

In the case of color photographic materials for photographing and reversal color photographic materials (e.g., color negative film, reversal film, reversal color paper), silver iodobromide, silver iodochloride and silver iodochlorobromide each having a silver iodide content of 0.1 to 30 mol % are preferred, with silver iodobromide containing 1 to 25 mol % of silver iodide being particularly preferred.

In the case of direct positive color photographic materials, silver bromide or silver chlorobromide is preferred, and silver chloride is preferred for rapid processing.

Photographic materials for paper preferably employ silver chloride or silver chlorobromide, and particularly, silver chlorobromide having a silver chloride content of preferably not lower than 80 mol %, more preferably not lower than 95 mol %, most preferably not lower than 98 mol % is preferred.

Silver halide grains in the photographic emulsions may have a regular crystal form such as cubic, octahedral or tetradecahedral, an irregular crystal form such as spherical or platy (tabular) form, a crystal form having a crystal defect such as a twinning plane or a composite form of these crystal forms.

The silver halide grain size may range from fine grains having a grain size of not larger than about 0.2 μm to large-size grains having a grain size of about 10 μm based on the diameter of the circle having the same area as the projected areas of the grains. Any of polydisperse emulsion and monodisperse emulsion can be used.

Silver halide photographic emulsions which can be used in the present invention can be prepared by methods described in *Research Disclosure* (RD) No. 17643 (Dec., 1978) pp. 22 to 23, Ibid., No. 307105 (Nov., 1989) pp. 863 to 865 "I. Emulsion preparation and types", Ibid., No. 18716 (Nov. 1979) p. 648, Glafkides, *Chemie et Phisique Photographique* (Paul Montel 1967), G. F. Duffin, *Photographic Emulsion Chemistry* (Focal press 1965) and V. L. Zelikman et al., *Making and Coating Photographic Emulsion* (Focal Press 1964).

Monodisperse emulsions described in U.S. Pat. Nos. 3,574,628 and 3,655,394 and U.K. Patent 1,413,748 are also preferred.

Tabular grains having an aspect ratio (average diameter/average thickness) of not lower than about 5 can be used in the present invention. Tabular grains can be easily prepared by methods described in Gutoff, *Photographic Science and Engineering,* Vol. 14, pages 248 to 257 (1970), U.S. Pat. Nos. 4,434,226, 4,414,310, 4,433,048 and 4,439,520 and U.K. Patent 2,112,157.

Crystal structure of the silver halide grains may be uniform. The interior of the grain and the surface layer thereof may be different in halogen composition, or the crystal may have laminar structure. Silver halide grains having different compositions may be joined to each other by epitaxial growth. Silver halide grain may be joined to a compound other than silver halide such as silver rhodanide or lead oxide. A mixture of grains having various crystal forms may be used.

Generally, silver halide emulsions are subjected to physical ripening, chemical ripening and spectral sensitization and then used. Additives used in these stages are described in *Research Disclosure* No. 17643, Ibid., No. 18716 and Ibid., 307105 and given in the following table.

Other conventional photographic additives which can be used in the present invention are also described in the aforesaid three Research Disclosures as set forth in the following table.

| Additive | RD17643 [Dec. '78] | RD18716 [Nov. '79] | RD307105 [Nov. '89] |
|---|---|---|---|
| 1. Chemical sensitizing agent | p. 23 | p. 648 right column (RC) | p. 866 |
| 2. Sensitivity increaser | — | p. 648 RC | — |
| 3. Spectral sensitizing agent, supersensitizing agent | pp. 23–24 | p. 648 RC–p. 649 RC | pp. 866–868 |
| 4. Brightener | p. 24 | p. 647 RC | p. 868 |
| 5. Antifogging agent, stabilizer | pp. 24–25 | p. 649 RC | pp. 868–870 |
| 6. Light absorber, filter dye, ultraviolet light absorber | pp. 25–26 | p. 649 RC–p. 650 left column (LC) | p. 873 |
| 7. Anti-staining agent | p. 25 RC | p. 650 LC-RC | p. 872 |
| 8. Dye image stabilizer | p. 25 | p. 650 LC | p. 872 |
| 9. Hardening agent | p. 26 | p. 651 LC | pp. 874–875 |
| 10. Binder | p. 26 | p. 651 LC | pp. 873–874 |
| 11. Plasticizer, lubricant | p. 27 | p. 650 RC | p. 876 |
| 12. Coating aid, surfactant | pp. 26–27 | p. 650 RC | pp. 875–876 |
| 13. Antistatic agent | p. 27 | p. 650 RC | pp. 876–877 |
| 14. Matting agent | | | pp. 878–879 |

Various color couplers can be used in the present invention. Specific examples thereof are described in patents cited in the aforesaid *Research Disclosure* (RD) No. 17643, VII-C to G, RD No. 30715, VII-C to G, JP-A-62-215272, JP-A-3-33847 and JP-A-2-33144.

Yellow couplers which preferably can be used include compounds described in U.S. Pat. Nos. 3,933,501, 4,022,620, 4,326,024, 4,401,752 and 4,248,961, JP-B-58-10739, U.K. Patents 1,425,020 and 1,476,760, U.S. Pat. Nos. 3,973,968, 4,314,023 and 4,511,649 and European Patent 249,473A.

As magenta couplers, 5-pyrazolone compounds and pyrazoloazole compounds are preferred. Particularly preferred examples of the magenta couplers include compounds described in European Patent 73,636, U.S. Pat. Nos. 4,310,619, 4,351,897, 3,061,432, 3,725,064, 4,500,630, 4,540,654 and 4,556,630, RD No. 24220 (Jun., 1984), RD No. 24230 (Jun., 1984), JP-A-60-33552, JP-A-60-43659, JP-A-61-72238, JP-A-60-35730, JP-A-55-118034, JP-A-60-185951 and WO(PCT)88/04795. Effects of improving bleach fog and stain are particularly remarkable with pyrazoloazole couplers.

Cyan couplers which can be used include phenol couplers and naphthol couplers. Examples of Suitable cyan couplers include compounds described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid-Open No. 3,329,729, European Patents 121,365A and 249,453A, U.S. Pat. Nos. 3,446,622, 4,333,999, 4,753,871, 4,451,559, 4,427,767, 4,690,889, 4,254,212 and 4,296,199 and JP-A-61-42658.

Preferred examples of colored couplers for correcting unwanted absorption of developed dyes include compounds described in RD No. 17643, item VII-G, U.S. Pat. No. 4,163,670, JP-B-57-39413, U.S. Pat. Nos. 4,004,929 and 4,138,258 and U.K. Patent 1,146,368. Further, it is preferred that couplers for correcting unwanted absorption of developed dyes by a fluorescent dye released during coupling as described in U.S. Pat. No. 4,774,181 and couplers having, as an eliminable group, a dye precursor group capable of reacting with a developing agent to form a dye as described in U.S. Pat. No. 4,777,120 are used.

Preferred couplers in which developed dyes have proper diffusibility include compounds described in U.S. Pat. No. 4,366,237, U.K. Patent 2,125,570, European Patent 96,570 and West German Patent Laid-Open No. 3,234,533.

Typical examples of dye forming polymer couplers are described in U.S. Pat. Nos. 3,451,820, 4,080,211, 4,367,282, 4,409,320 and 4,576,910 and U.K. Patent 2,102,173.

Couplers which release a photographically useful group upon coupling can be advantageously used in the present invention. Preferred examples of DIR couplers which release a development inhibitor include compounds described in patent specifications cited in the aforesaid RD No. 17643, item VII-F, JP-A-57-151944, JP-A-57-154234, JP-A-60-18428, JP-A-63-37346 and U.S. Pat. Nos. 4,248,962 and 4,782,012.

Preferred examples of couplers which release imagewise a nucleating agent or a development accelerator during development include compounds described in U.K. Patents 2,097,140 and 2,131,188, JP-A-59-157638 and JP-A-59-170840.

Examples of other couplers which can be used in the photographic materials of the present invention include competing couplers described in U.S. Pat. No. 4,130,427, polyequivalent type couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A-60-185950 and JP-A-62-24252, couplers which release a dye which is restored to the original color after elimination described in European Patent 173,302A, couplers which release a bleaching accelerator described in RD No. 11449 and Ibid. No. 24241 and JP-A-61-201247, couplers which release a ligand described in U.S. Pat. No. 4,553,477, couplers which release a leuco dye described in JP-A-63-75747 and couplers which release a fluorescent dye described in U.S. Pat. No. 4,774,181.

The couplers which are used in the present invention can be introduced into the photographic materials by various known methods such as an oil-in-water dispersion or latex dispersion.

Examples of high-boiling organic solvents which are used in oil-in-water dispersion methods are described in U.S. Pat. No. 2,322,027, etc. Specific examples of high-boiling organic solvents having a boiling point of not lower than 175° C. under atmospheric pressure, which are used in the oil-in-water dispersion methods, include phthalic esters (e.g., dibutyl phthalate, dicyclohexyl phthalate, di-2-ethylhexyl phthalate, decyl phthalate, bis(2,4-di-t-amylphenyl)-phthalate, bis(2,4-di-t-amylphenyl)isophthalate, bis-(1,1-diethylpropyl)phthalate, etc.), phosphoric acid or phosphonic esters (e.g., triphenyl phosphate, tricresyl phosphate, 2-ethylhexyl diphenyl phosphate, tricyclohexyl phosphate, tri-2-ethylhexyl phosphite, tridodecyl phosphate, tributoxyethyl phosphate, trichloropropyl phosphate, di-2-ethylhexyl phenyl phosphate, etc.), benzoic esters (e.g., 2-ethylhexyl benzoate, dodecyl benzoate, 2-ethylhexyl p-hydroxybenzoate, etc.), amides (e.g., N,N-diethyldodecaneamide, N,N-diethyllaurylamide, N-tetradecylpyrrolidone, etc.), alcohols and phenols (e.g., isostearyl alcohol, 2,4-di-tert-amylphenol, etc.), aliphatic carboxylic acid esters (e.g., bis(2-ethylhexyl) sebacate, dioctyl azelate, glycerol tributyrate, isostearyl lactate, trioctyl citrate, etc.), aniline derivatives (e.g., N,N-dibutyl-2-butoxy-5-tert-octylaniline, etc.) and hydrocarbons (e.g., paraffin, dodecylbenzene, diisopropylnaphthalene, etc.). Co-solvents which can be used include organic solvents having a boiling point of not lower than about 30° C., preferably not lower than about 50° C., but not higher than about 160° C. Typical examples of such organic solvents include ethyl acetate, butyl acetate, ethyl propionate, methyl ethyl ketone, cyclohexanone, 2-ethoxyethyl acetate and dimethylformamide.

The stages and effects of the latex dispersion method and examples of impregnating latexes are described in U.S. Pat. No. 4,199,363, West German Application (OLS) Nos. 2,541,274 and 2,541,230.

In the latex dispersion method, the couplers which are used in the present invention are impregnated with a roadable latex polymer (e.g., described in U.S. Pat. No. 4,203,716) in the presence or absence of the high-boiling organic solvent, or are dissolved in water-insoluble, organic solvent-soluble polymers and then emulsified and dispersed in an aqueous solution of hydrophilic colloid.

Preferably, homopolymers or copolymers described in WO(PCT)88/00723 (pages 12 to 30) are used in the latex dispersion method. Particularly, the use of acrylamide polymers is preferred from the viewpoint of stabilizing dye image.

Examples of supports suitable for use in the present invention are described in, for example, the aforesaid RD No. 17643 (page 28) and Ibid , No. 18716 (page 648 right column to page 648 left column).

The present invention can be applied to various color photographic materials. Typical examples of the color photographic materials include general-purpose and movie color negative films, reversal color films for slide and TV, color paper, direct positive color paper, color positive films and reversal color paper. Reversal color films which may employ the present invention may be coupler-in-emulsion type color film (the coupler being incorporated in the photographic material) and a coupler-in-developer type color film (the coupler being contained in the developer).

The present invention is now illustrated in greater detail by reference to the following examples which, however, are not to be construed as limiting the invention in any way.

EXAMPLE 1

An undercoated cellulose triacetate film support was coated with the following layers having the following compositions to prepare a multi-layer color photographic material as sample 101.

Composition of Sensitive Layer

The amounts of silver halide and colloidal silver are represented by coating weight in g/m$^2$ in terms of silver. The amounts of couplers, additives and gelatin are represented by coating weight in g/m$^2$. The amounts of sensitizing dyes are represented by moles per one mole of silver halide in the same layer.

| | |
|---|---|
| First layer: antihalation layer | |
| Black colloidal silver | 0.20 (as silver) |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| Second layer: interlayer | |
| Fine silver iodobromide grains (AgI content: 1.0 mol %, grain size in terms of a diameter of a sphere: 0.07 μm) | 0.15 (as silver) |
| Gelatin | 1.00 |
| EXC-4 | $6.0 \times 10^{-2}$ |
| Cpd-3 | $2.0 \times 10^{-2}$ |
| Third Layer: first red-sensitive emulsion layer | |
| Silver iodobromide emulsion (AgI content: 5.0 mol %, surface high AgI type, grain size (in terms of a diameter of a sphere): 0.9 μm, a coefficient of variation in grain size (in terms of a diameter of a sphere): 21%, tabular grains, ratio of diameter/thickness: 7.5) | 0.42 (as silver) |
| Silver iodobromide emulsion (AgI content: 4.0 mol %, interior high AgI type, grain size (in terms of a diameter of a sphere): 0.4 μm, a coefficient of variation in grain size (in terms of a diameter of a sphere): 18%, tetradecahedral grains) | 0.40 (as silver) |
| Gelatin | 1.90 |
| ExS-1 | $4.5 \times 10^{-4}$ mol |
| ExS-2 | $1.5 \times 10^{-4}$ mol |
| ExS-3 | $4.0 \times 10^{-5}$ |
| ExC-1 | 0.65 |
| ExC-3 | $1.0 \times 10^{-2}$ |
| ExC-4 | $2.3 \times 10^{-2}$ |
| Solv-1 | 0.32 |
| Fourth layer: second red-sensitive emulsion layer | |
| Silver iodobromide emulsion (AgI content: 8.5 mol %, interior high AgI type, grain size (in terms of a diameter of a sphere): 1.0 μm, a coefficient of variation in grain size (in terms of a diameter of a sphere): 25%, platy grains, ratio of diameter/thickness: 3.0) | 0.85 (as silver) |
| Gelatin | 0.91 |
| EXS-1 | $3.0 \times 10^{-4}$ mol |
| EXS-2 | $1.0 \times 10^{-4}$ mol |
| ExS-3 | $3.0 \times 10^{-5}$ mol |

-continued

| | |
|---|---|
| ExC-1 | 0.13 |
| ExC-2 | $6.2 \times 10^{-2}$ |
| ExC-4 | $4.0 \times 10^{-2}$ |
| Solv-1 | 0.10 |
| Fifth layer: third red-sensitive emulsion layer | |
| Silver iodobromide emulsion (AgI content: 11.3 mol %, interior high AgI type, grain size (in terms of a diameter of a sphere): 1.4 μm, a coefficient of variation in grain size (in terms of a diameter of a sphere): 28%, platy grains, ratio of diameter/thickness: 6.0) | 1.50 (as silver) |
| Gelatin | 1.20 |
| ExS-1 | $2.0 \times 10^{-4}$ mol |
| ExS-2 | $6.0 \times 10^{-5}$ mol |
| ExS-3 | $2.0 \times 10^{-5}$ mol |
| ExC-2 | $8.5 \times 10^{-2}$ |
| ExC-5 | $7.3 \times 10^{-2}$ |
| Solv-1 | 0.12 |
| Solv-2 | 0.12 |
| Sixth layer: interlayer | |
| Gelatin | 1.00 |
| Cpd-4 | $8.0 \times 10^{-2}$ |
| Solv-1 | $8.0 \times 10^{-2}$ |
| Seventh layer: first green-sensitive emulsion layer | |
| Silver iodobromide emulsion (AgI content: 5.0 mol %, surface high AgI type, grain size (in terms of a diameter of a sphere): 0.9 μm, a coefficient of variation in grain size (in terms of a diameter of a sphere): 21%, tabular grains, ratio of diameter/thickness: 7.0) | 0.28 (as silver) |
| Silver iodobromide emulsion (AgI content: 4.0 mol %, interior high AgI type, grain size (in terms of a diameter of a sphere): 0.4 μm, a coefficient of variation in grain size (in terms of a diameter of a sphere): 18%, tetradecahedral grains) | 0.16 (as silver) |
| Gelatin | 1.20 |
| ExS-4 | $5.0 \times 10^{-4}$ mol |
| ExS-5 | $2.0 \times 10^{-4}$ mol |
| ExS-6 | $1.0 \times 10^{-4}$ mol |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| Eighth layer: second green-sensitive emulsion layer | |
| Silver iodobromide emulsion (AgI content: 8.5 mol %, interior high Ag I type, grain size (in terms of a diameter of a sphere): 1.0 μm, a coefficient of variation in grain size (in terms of a diameter of sphere): 25%, platy grains, ratio of diameter/thickness: 3.0) | 0.57 (as silver) |
| Gelatin | 0.45 |
| ExS-4 | $3.5 \times 10^{-4}$ mol |
| ExS-5 | $1.4 \times 10^{-4}$ mol |
| ExS-6 | $7.0 \times 10^{-5}$ mol |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| Ninth layer: interlayer | |
| Gelatin | 0.50 |
| Solv-1 | $2.0 \times 10^{-2}$ |
| Tenth layer: third green-sensitive emulsion layer | |
| Silver iodobromide emulsion (AgI content: 11.3 mol %, interior high AgI type, grain size (in terms of a diameter of a sphere): 1.4 μm, a coefficient of variation in grain size (in terms of a diameter of a sphere): 28%, platy grains, ratio of diameter/thickness: 6.0) | 1.30 (as silver) |
| Gelatin | 1.20 |
| ExS-4 | $2.0 \times 10^{-4}$ mol |
| ExS-5 | $8.0 \times 10^{-5}$ mol |
| EXS-6 | $8.0 \times 10^{-5}$ mol |
| ExM-4 | $4.5 \times 10^{-2}$ |
| ExM-6 | $1.0 \times 10^{-2}$ |

-continued

| | |
|---|---|
| ExC-2 | $4.5 \times 10^{-3}$ |
| Cpd-5 | $1.0 \times 10^{-2}$ |
| Solv-1 | 0.25 |
| Eleventh layer: yellow filter layer | |
| Gelatin | 0.50 |
| Cpd-6 | $5.2 \times 10^{-2}$ |
| Solv-1 | 0.12 |
| Twelfth layer: interlayer | |
| Gelatin | 0.45 |
| Cpd-3 | 0.10 |
| Thirteenth layer: first blue-sensitive emulsion layer | |
| Silver iodobromide emulsion (AgI content: 2 mol %, uniform AgI type, grain size (in terms of a diameter of a sphere): 0.55 μm, a coefficient of variation in grain size (in terms of a diameter of a sphere): 25%, tabular grains, ratio of diameter/thickness: 7.0) | 0.20 (as silver) |
| Gelatin | 1.00 |
| ExS-7 | $3.0 \times 10^{-4}$ mol |
| ExY-1 | 0.60 |
| ExY-2 | $2.3 \times 10^{-2}$ |
| Solv-1 | 0.15 |
| Fourteenth layer: second blue-sensitive emulsion layer | |
| Silver iodobromide emulsion (Ag I content: 19.0 mol %, interior high AgI type, grain size (in terms of a diameter of a sphere): 1.0 μm, a coefficient of variation in grain size (in terms of a diameter of a sphere): 16%, octahedral grains) | 0.10 (as silver) |
| Gelatin | 0.35 |
| ExS-7 | $2.0 \times 10^{-4}$ mol |
| ExY-1 | 0.22 |
| Solv-1 | $7.0 \times 10^{-2}$ |
| Fifteenth layer: interlayer | |
| Fine silver iodobromide grains (Ag I content: 2 mol %, uniform AgI type, grain size (in terms of a diameter of a sphere): 0.13 μm) | 0.20 (as silver) |
| Gelatin | 0.36 |
| Sixteenth layer: third blue-sensitive emulsion layer | |
| Silver iodobromide emulsion (AgI content: 14.0 mol/%, interior high AgI type, grain size (in terms of a diameter of a sphere): 1.7 μm, a coefficient of variation in grain size (in terms of a diameter of a sphere): 28%, platy grains, ratio of diameter/thickness: 5.0) | 1.55 (as silver) |
| Gelatin | 1.00 |
| ExS-8 | $1.5 \times 10^{-4}$ mol |
| ExY-1 | 0.21 |
| Solv-1 | $7.0 \times 10^{-2}$ |
| Seventeenth layer: first protective layer | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Eighteenth layer: second protective layer | |
| Fine silver chloride grains (grain size (in terms of a diameter of a sphere): 0.07 μm) | 0.36 (as silver) |
| Gelatin | 0.70 |
| B-1 (diameter 1.5 μm) | $2.0 \times 10^{-2}$ |
| B-2 (diameter 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

To the sample were added, 1,2-benzisothiazoline-3-one (about 200 ppm), n-butyl p-hydroxybenzoate (about 1,000 ppm) and 2-phenoxyethanol )about 10,000 ppm), each amount being based on the amount of gelatin. Further, B-4, B-5, W-2, W-3, F-1, F-2, F-3, F-4, F-5, F-6, F-7, F-8, F-9, F-10, F-11, F-12, F-13, iron salt, lead salt, gold salt, platinum salt, iridium salt and rhodium salt were contained therein.

UV-1
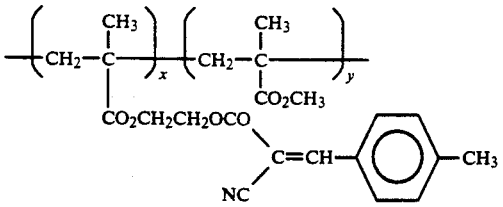
x/y = 7/3 (weight ratio)
UV-2
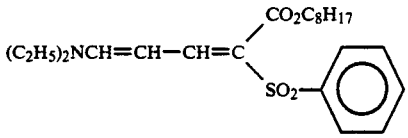
ExC-1
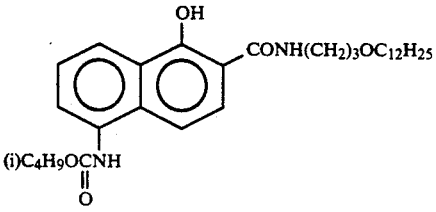
ExC-2
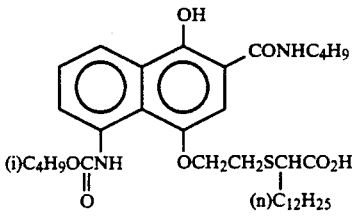
ExC-3
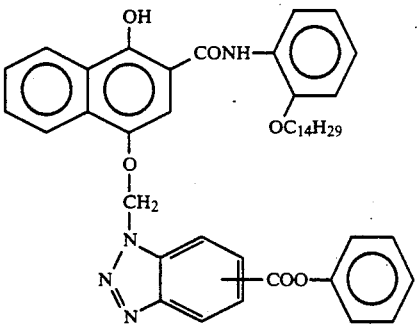
ExC-4
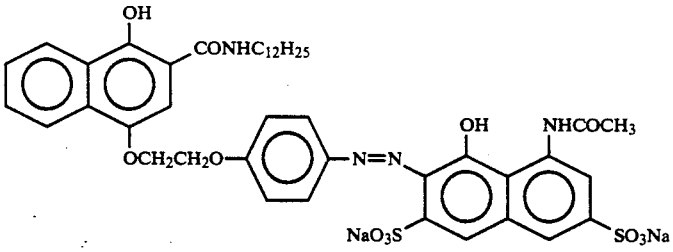
ExC-5
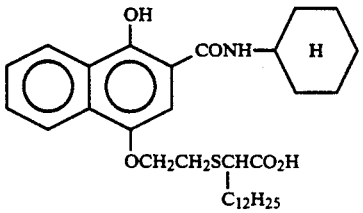

ExM-1
-continued
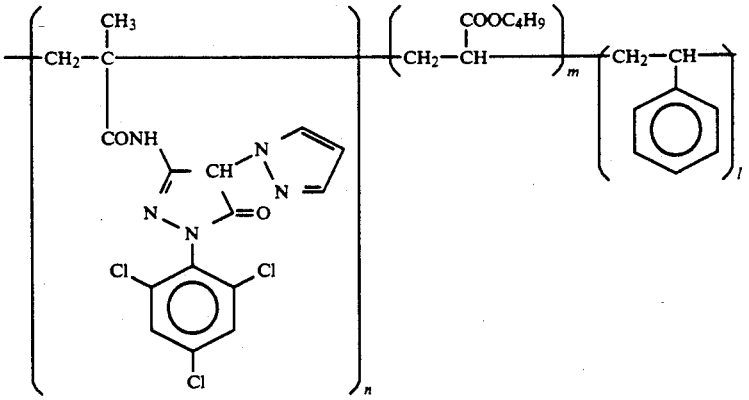
n:m:l = 2:1:1 (weight ratio)
ave. molecular weight 20,000
ExM-2
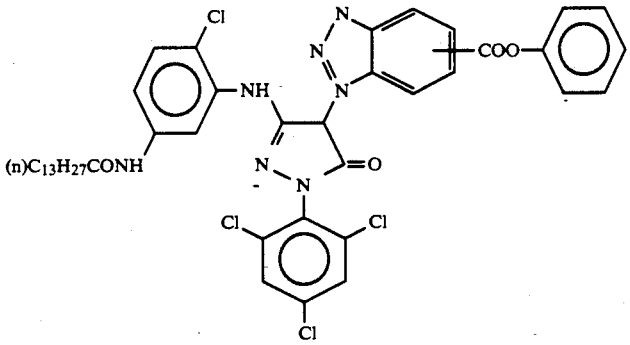
ExM-3
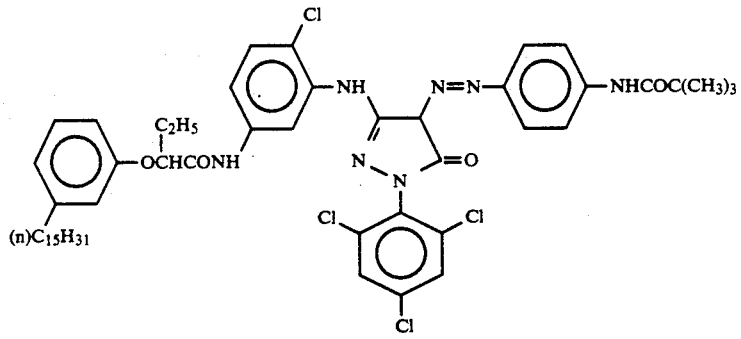
ExM-4
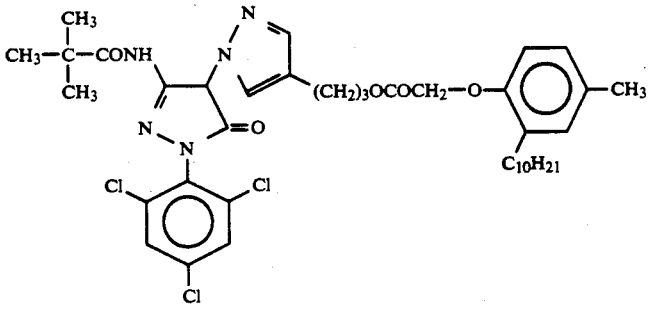

ExM-5
-continued
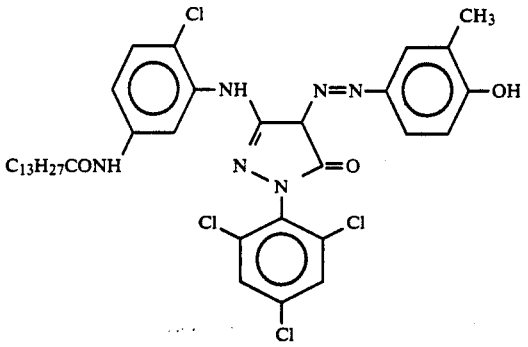
ExM-6
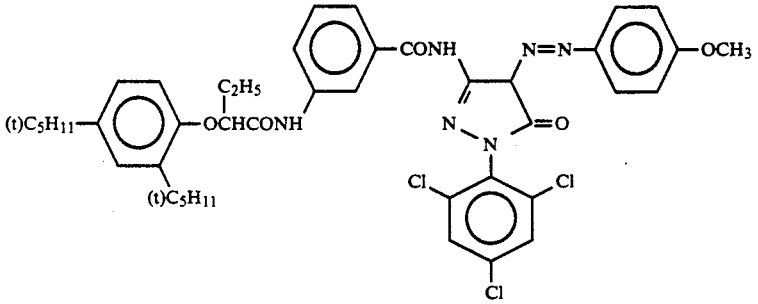
ExY-1
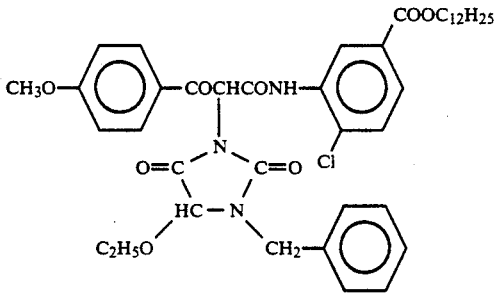
ExY-2
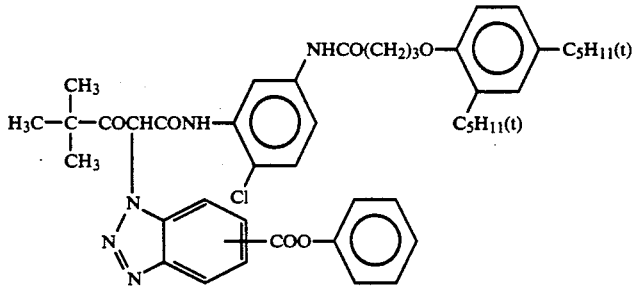
Cpd-1
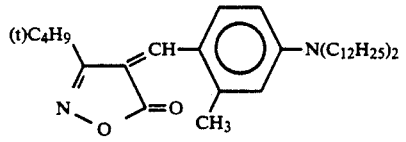

Cpd-2
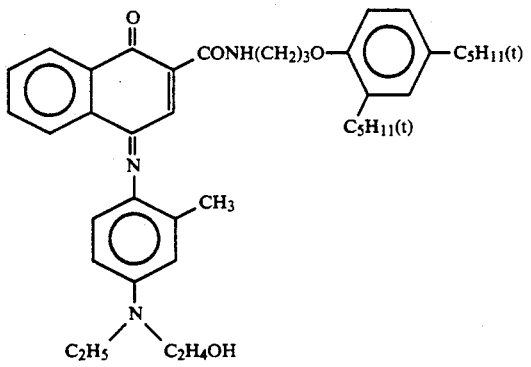
-continued
Cpd-3
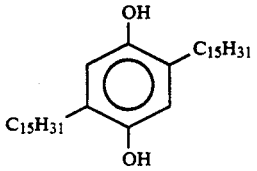
Cpd-4
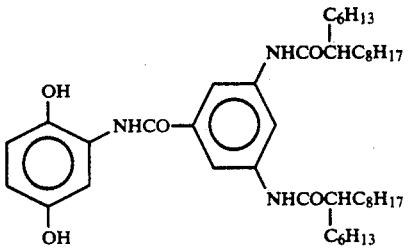
Cpd-5
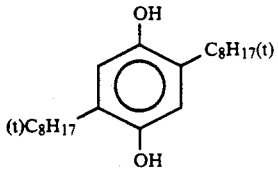
Cpd-6
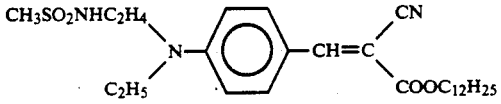
Cpd-7
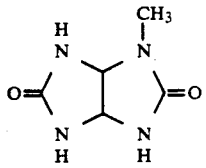
Solv-1
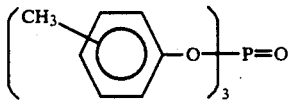
Solv-2
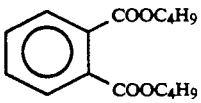
Solv-3
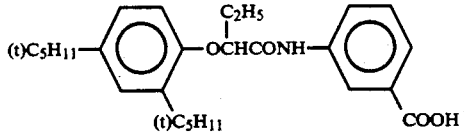
ExS-1
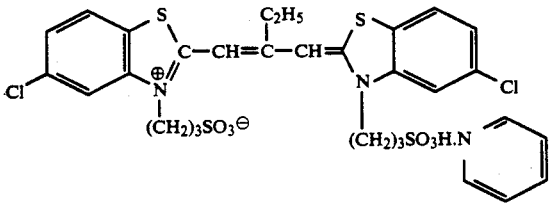
ExS-2
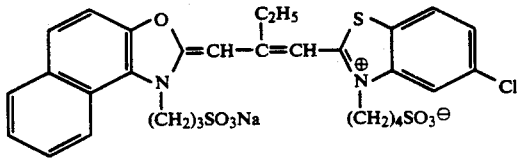

ExS-3
-continued
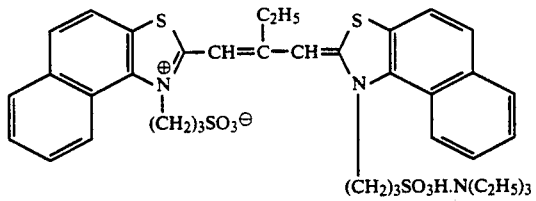
ExS-4
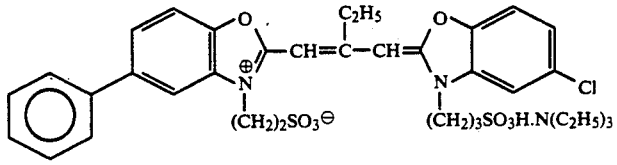
ExS-5
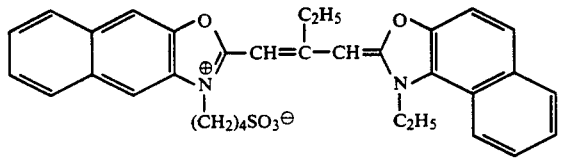
ExS-6
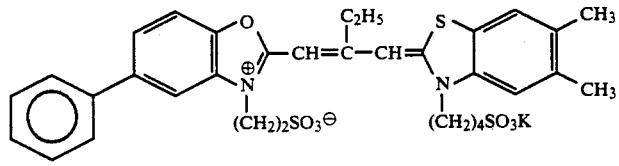
ExS-7
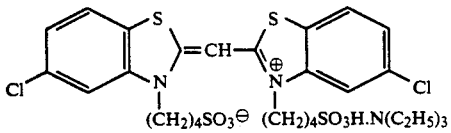
ExS-8
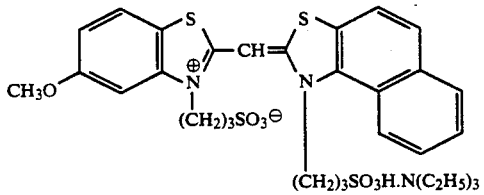
B-1
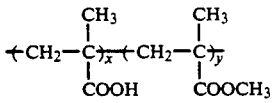
x/y = 10/90
B-2
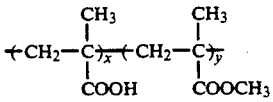
x/y = 40/60
B-3
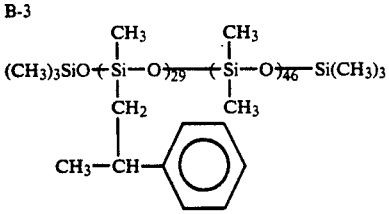
B-4
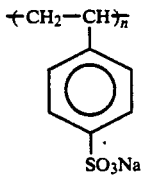
B-5
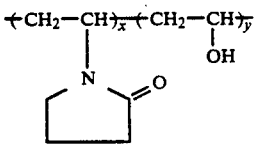
x/y = 70/30
W-1
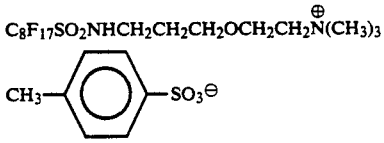

W-2

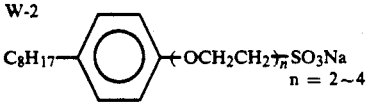

H-1

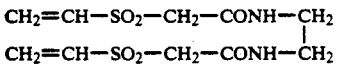

F-2

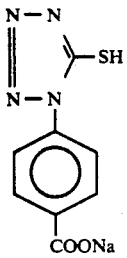

F-4

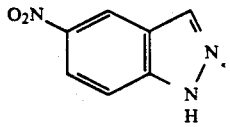

F-6

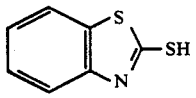

F-8

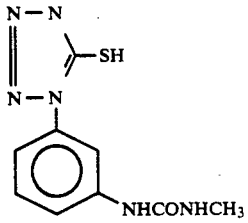

F-10

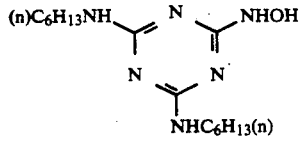

F-12

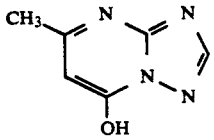

-continued

W-3

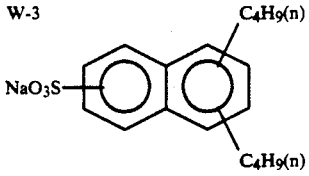

F-1

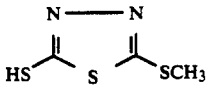

F-3

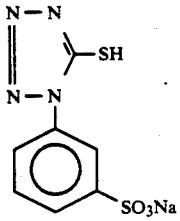

F-5

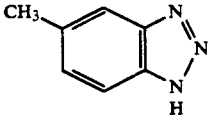

F-7

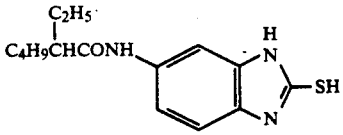

F-9

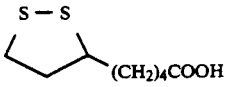

F-11

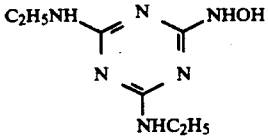

F-13

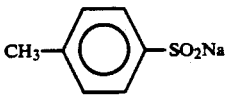

The thus prepared sample 101 was exposed to white light (color temperature; 4800° K.) through an optical wedge and then processed in the following processing stages. In the processing, a cine system automatic processor was used, and the processing was continued until the accumulated value of the replenishment rate for each processing bath reached 2.5 times the tank capacity. Processing performances described below were results obtained by conducing processing at this point. The bleaching bath was provided with a subtank and aerating the bleaching solution, and about 200 ml of air per minute was passed through while the processing was conducted.

The processing stages were as follows.

| Stage | Processing stage: Processing time | Processing temp. | Replenishment rate* | Tank capacity |
|---|---|---|---|---|
| Color development | 3 min. 15 sec. | 38.0° C. | 23 ml | 15 l |
| Bleaching | 50 sec. | 38.0° C. | 5 ml | 5 l |
| Blixing | 50 sec. | 38.0° C. | — | 5 l |
| Fixing | 50 sec. | 38.0° C. | 16 ml | 5 l |
| Rinse (1) | 30 sec. | 38.0° C. | — | 3 l |
| Rinse (2) | 20 sec. | 38.0° C. | 34 ml | 3 l |
| Stabilization | 20 sec. | 38.0° C. | 20 ml | 3 l |
| Drying | 1 min. | 55° C. | | |

*Replenishment rate being per 1 m long by 35 mm wide.

The rinse was a countercurrent system of from (2) to (1), and all of the overflow solution of rinsing water was introduced into the fixing bath. The replenishment to the blixing bath was made in such a manner that the upper part of the bleaching tank of the automatic processor was connected with the bottom of the blixing tank through a pipe, the upper part of the fixing tank was connected with the bottom of the blixing tank and all of the overflow solutions produced by feeding the replenishers to the bleaching tank and the fixing tank was allowed to flow into the blixing bath. The amount of the developing solution carried over to the bleaching stage, the amount of bleaching solution carried over to the blixing stage, the amount of blixing solution carried over to the fixing stage and the amount of fixing solution carried over to the rinsing stage were 2.5 ml, 2.0 ml, 2.0 ml and 2.0 ml, respectively, each amount being per $m^2$ of the photographic material having a width of 35 mm. Cross-over time was 5 seconds for each stage. This time was included in the processing stage of the prestage.

Each processing solution has the following composition.

| | Mother Solution (g) | Replenisher (g) |
|---|---|---|
| Developing solution | | |
| Diethylenetriaminepentaacetic acid | 2.0 | 2.2 |
| 1-Hydroxyethylidene-1,1-diphosphonic acid | 3.3 | 3.3 |
| Sodium sulfite | 3.9 | 5.2 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-(β-hydroxyethyl)amino] sulfate | 4.5 | 6.1 |
| Water to make | 1.0 l | 1.0 l |
| pH | 10.05 | 10.15 |
| Bleaching solution | | |
| Compound described in Table 1 | 0.383 mol | 0.547 mol |
| Ferric nitrate nonahydrate | 0.365 mol | 0.521 mol |
| Ammonium bromide | 84.0 | 120.0 |
| Ammonium nitrate | 17.5 | 25.0 |
| Hydroxyacetic acid | 63.0 | 90.0 |
| Acetic acid | 33.2 | 47.4 |
| Water to make | 1.0 l | 1.0 l |
| pH (adjusted with ammonia water) | 3.60 | 2.80 |
| Blixing solution (mother solution) | | |
| The blixing solution was a 15:85 mixed solution of the mother solution of the above bleaching solution and the mother solution of the following fixing solution. | | |
| Fixing solution | | |
| Ammonium sulfite | 19.0 | 57.0 |
| Aqueous solution of ammonium thiosulfate (700 g/l) | 280 ml | 840 ml |
| Imidazole | 28.5 | 85.5 |
| Ethylendiaminetetraacetic acid | 12.5 | 37.5 |
| Water to make | 1.0 l | 1.0 l |
| pH (adjusted with ammonia water and acetic acid) | 7.40 | 7.45 |
| Rinsing water | | |
| The mother solution and the replenisher were the same. | | |

Tap water was passed through a mixed bed column packed with H type strongly acidic cation exchange resin (Amberlite IR-120B, a product of Rohm & Hass Co.) and OH type strongly basic anion exchange resin (Amberlite IRA-400) to reduce the concentration of calcium and magnesium ions to not higher than 3 mg/l. Subsequently, sodium dichloroisocyanulate (20 mg/l) and sodium sulfate (150 mg/l) were added thereto. The pH of the solution was in the range of 6.5 to 7.5.

| Stabilizing solution (unit: g) The mother solution and the replenisher were the same. | |
|---|---|
| Formalin (37%) | 2.0 ml |
| Polyoxyethylene p-monononyphenyl ether (average degree of polymerization: 10) | 0.3 |
| Disodium ethylenediaminetetraacetate | 0.05 |
| Water to make | 1.0 l |
| pH | 5.0–8.0 |

The amount of residual silver in the maximum density area of sample 101 processed in the manner mentioned above was measured by X-ray fluorometry. The results are shown in Table 1. Further, green density (hereafter "G density") in the Dmin area was measured (1). Separately, the bleaching solution in the automatic processor was replaced with a bleaching solution having the following composition (standard bleaching solution) and no bleach fog, and the sample was processed. G density in the Dmin area of the sample processed with the standard bleaching solution was measured (2). The difference between the G density (1) and (2) above was referred to as bleach fog. The results are shown in Table 1.

| Standard bleaching solution) | |
|---|---|
| Sodium ethylenediaminetetraacetato ferrate trihydrate | 100 g |
| Disodium ethylenediaminetetraacetate | 10 g |
| Ammonium bromide | 100 g |
| Ammonium nitrate | 30 g |
| Ammonia water (27%) | 6.5 ml |
| Water to make | 1.0 l |
| pH | 6.0 |

The above sample was stored at 60° C. and 70% RH for 4 weeks, and an increase in G density in the Dmin area was measured. The results are shown in Table 1.

TABLE 1

| No. | Compound | Amount of residual silver ($\mu g/cm^2$) | Bleach fog $\Delta D_{min}$ (G) | Increase in stain with time $\Delta D_{min}$ (G) | Remarks |
|---|---|---|---|---|---|
| 101 | Comparative compound A | 14.1 | 0.00 | 0.30 | Comparison |
| 102 | Comparative compound B | 0.8 | 0.09 | 0.15 | " |
| 103 | Comparative compound C | 27.5 | 0.03 | 0.25 | " |
| 104 | Comparative compound D | 16.2 | 0.01 | 0.38 | " |
| 105 | Compound 4 | 1.7 | 0.02 | 0.02 | Invention |
| 106 | Compound 7 | 0.5 | 0.01 | 0.03 | " |
| 107 | Compound 8 | 0.8 | 0.00 | 0.04 | " |
| 108 | Compound 11 | 1.1 | 0.00 | 0.05 | " |
| 109 | Compound 12 | 0.9 | 0.01 | 0.06 | " |
| 110 | Compound 13 | 0.3 | 0.03 | 0.02 | " |
| 111 | Compound 26 | 1.2 | 0.04 | 0.03 | " |
| 112 | Compound 30 | 1.9 | 0.01 | 0.04 | " |
| 113 | Compound 36 | 0.9 | 0.02 | 0.04 | " |

Comparative compound A: ethylenediaminetetraacetic acid
Comparative compound B: 1,3-diaminopropanetetraacetic acid
Comparative compound C: nitrilotriacetic acid
Comparative compound D: cyclohexanediaminetetraacetic acid It is apparent from the results of Table 1 that the solutions having a bleaching ability which contain the metal chelate compounds of the present invention reduce the amount of residual silver, scarcely cause bleach fog, exhibit little increase in stain after processing and have excellent performance in comparison with the solutions containing comparative compounds.

EXAMPLE 2

An undercoated cellulose triacetate film support was coated with the following layers having the following compositions to prepare a multi-layer color photographic material as sample 102.

Composition of Sensitive Layer

Numerals given to ingredients represent coating weight in $g/m^2$. The amount of silver halide is represented by coating weight in terms of silver. The amount of sensitizing dyes are represented by moles per one mole of silver halide in the same layer.

| Sample 102 | |
|---|---|
| **First layer (antihalation layer)** | |
| Black colloidal silver (in terms of silver) | 0.18 |
| Gelatin | 1.40 |
| **Second layer (interlayer)** | |
| 2,5-Di-t-pentadecylhydroquinone | 0.18 |
| EX-1 | 0.070 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| **Third layer (first red-sensitive emulsion layer)** | |
| Emulsion A (in terms of silver) | 0.25 |
| Emulsion B (in terms of silver) | 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.34 |
| EX-10 | 0.020 |
| U-1 | 0.070 |
| U-2 | 0.050 |
| U-3 | 0.070 |
| HBS-1 | 0.060 |
| Gelatin | 0.87 |

-continued

| | |
|---|---|
| **Fourth layer (second red-sensitive emulsion layer)** | |
| Emulsion G (in terms of silver) | 1.00 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.40 |
| EX-3 | 0.050 |
| EX-10 | 0.015 |
| U-1 | 0.070 |
| U-2 | 0.050 |
| U-3 | 0.070 |
| Gelatin | 1.30 |
| **Fifth layer (third red-sensitive emulsion layer)** | |
| Emulsion D (in terms of silver) | 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| **Sixth layer (interlayer)** | |
| EX-5 | 0.040 |
| HBS-1 | 0.020 |
| Gelatin | 0.80 |
| **Seventh layer (first green-sensitive layer)** | |
| Emulsion A (in terms of silver) | 0.15 |
| Emulsion B (in terms of silver) | 0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| **Eighth layer (second green-sensitive emulsion layer)** | |
| Emulsion C (in terms of silver) | 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| **Ninth layer (third green-sensitive emulsion layer)** | |
| Emulsion E (in terms of silver) | 1.20 |

-continued

| | |
|---|---|
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.025 |
| EX-11 | 0.10 |
| EX-13 | 0.015 |
| HBS-1 | 0.25 |
| HBS-2 | 0.10 |
| Gelatin | 1.54 |
| Tenth layer (yellow filter layer) | |
| Yellow colloidal silver (in terms of silver) | 0.050 |
| EX-5 | 0.080 |
| HBS-1 | 0.030 |
| Gelatin | 0.95 |
| Eleventh layer (first blue-sensitive emulsion layer) | |
| Emulsion A (in terms of silver) | 0.080 |
| Emulsion B (in terms of silver) | 0.070 |
| Emulsion F (in terms of silver) | 0.070 |
| Sensitizing dye VII | $3.5 \times 10^{-4}$ |
| EX-8 | 0.042 |
| EX-9 | 0.72 |
| HBS-1 | 0.28 |
| Gelatin | 1.10 |
| Twelfth layer (second blue-sensitive emulsion layer) | |
| Emulsion G (in terms of silver) | 0.45 |
| Sensitizing dye VII | $2.1 \times 10^{-4}$ |
| EX-9 | 0.15 |
| EX-10 | $7.0 \times 10^{-3}$ |
| HBS-1 | 0.050 |
| Gelatin | 0.78 |
| Thirteenth layer (third blue-sensitive emulsion layer) | |
| Emulsion H (in terms of silver) | 0.77 |

-continued

| | |
|---|---|
| Sensitizing dye VII | $2.2 \times 10^{-4}$ |
| EX-9 | 0.20 |
| HBS-1 | 0.070 |
| Gelatin | 0.69 |
| Fourteenth layer (first protective layer) | |
| Emulsion I (in terms of silver) | 0.20 |
| U-4 | 0.11 |
| U-5 | 0.17 |
| HBS-1 | $5.0 \times 10^{-2}$ |
| Gelatin | 1.00 |
| Fifteenth layer (second protective layer) | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

Further, all layers contained W-1, W-2, W-3, B-4, B-5, F-1, F-2, F-3, F-4, F-5, F-6, F-7, F-8, F-9, F-10, F-11, F-12, F-13, iron salt, lead salt, gold salt, platinum salt iridium salt and rhodium salt to improve preservability, processability, pressure resistance, anti-fungal and antibacterial properties, antistatic properties and coatability.

Emulsions A to I (silver iodobromide emulsions) and the other compounds used in preparation of sample 102 are shown below. The compounds of H-1, B-1, to B-5, W-1, to W-3 and F-1 to F-13 are the same as those used in Example 1.

| | Average AgI content (%) | Mean grain size (μm) | Coefficient of variation in grain size (%) | Ratio of diameter/ thickness | Ratio of amount of silver (AgI content %) |
|---|---|---|---|---|---|
| Emulsion A | 4.0 | 0.45 | 27 | 1 | core/shell = 1/3(13/1), double-structure grain |
| Emulsion B | 8.9 | 0.70 | 14 | 1 | core/shell = 3/7(25/2), double-structure grain |
| Emulsion C | 10 | 0.75 | 30 | 2 | core/shell = 1/2(24/3), double-structure grain |
| Emulsion D | 16 | 1.05 | 35 | 2 | core/shell = 4/6(40/0), double-structure grain |
| Emulsion E | 10 | 1.05 | 35 | 3 | core/shell = 1/2(24/3), double-structure grain |
| Emulsion F | 4.0 | 0.25 | 28 | 1 | core/shell = 1/3(13/1), double-structure grain |
| Emulsion G | 14.0 | 0.75 | 25 | 2 | core/shell = 1/2(42/0), double-structure grain |
| Emulsion H | 14.5 | 1.30 | 25 | 3 | core/shell = 37/63(34/3), double structure grain |
| Emulsion I | 1 | 0.07 | 15 | 1 | uniform grain |

EX-1

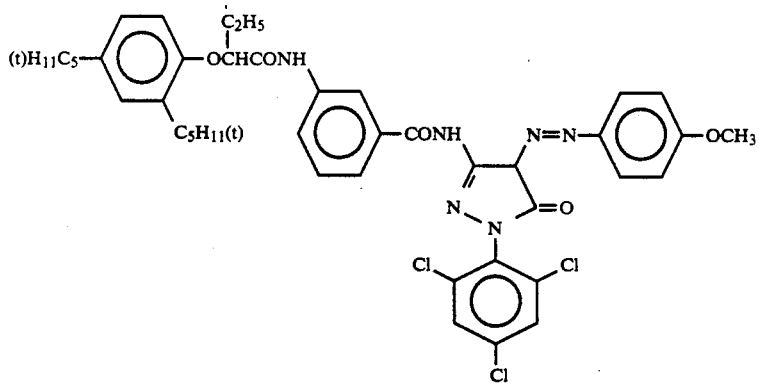

EX-2

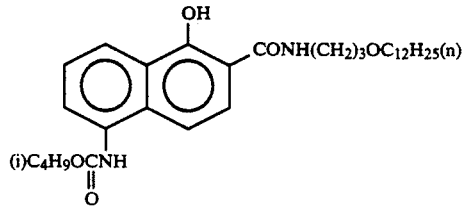

-continued
EX-3
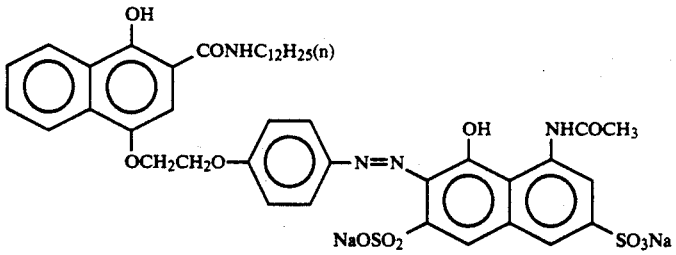
EX-4
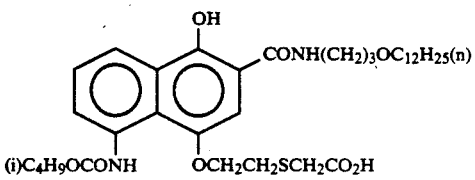
EX-5
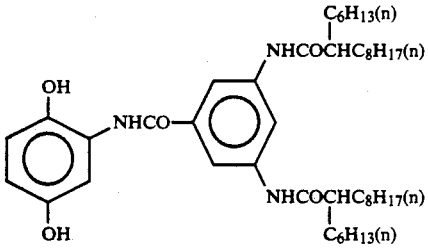
EX-6
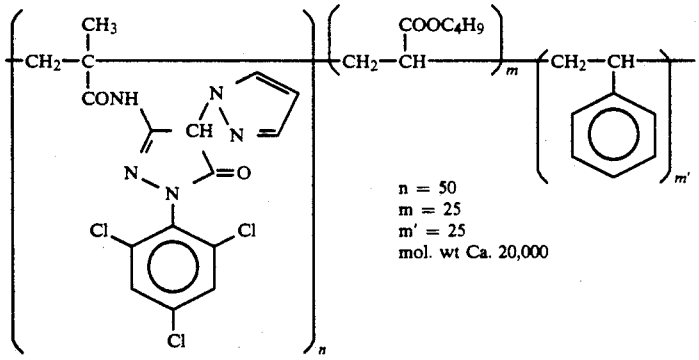
EX-7
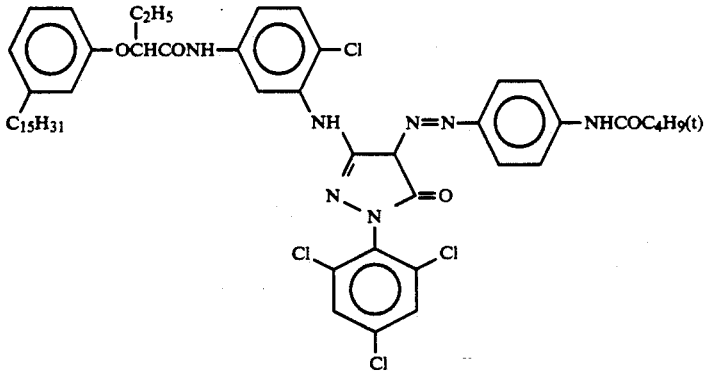

-continued
EX-8
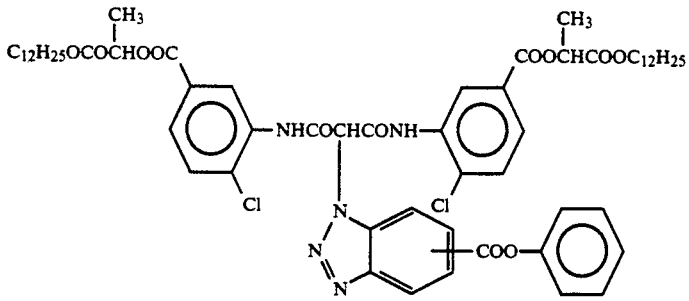
EX-9
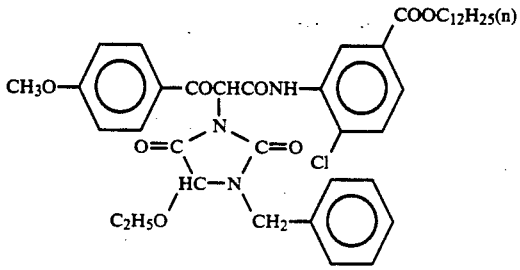
EX-10
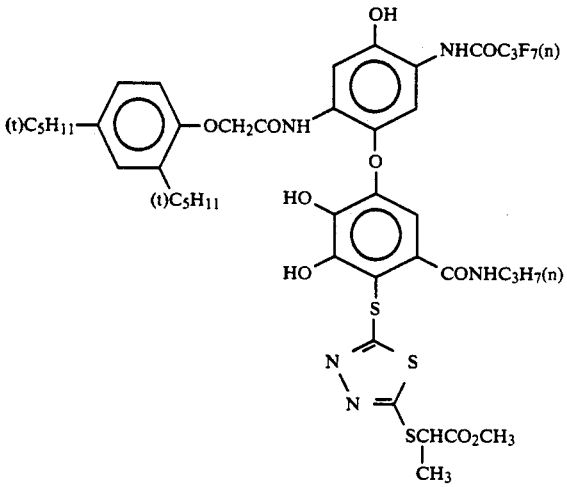
EX-11
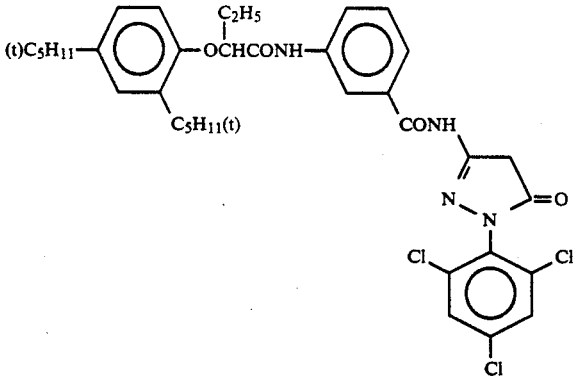
EX-12
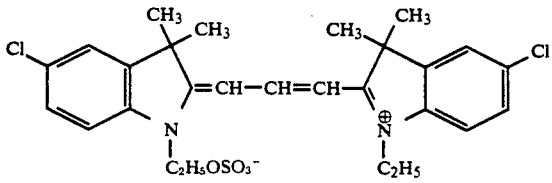

-continued
EX-13
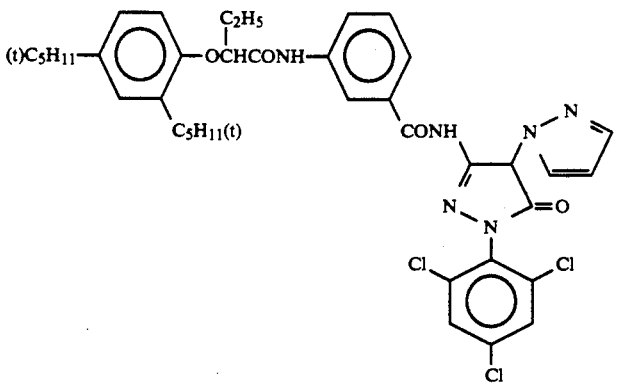
U-1
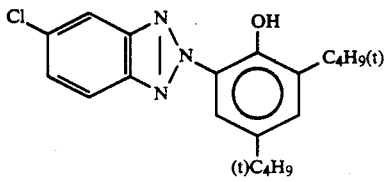
U-2
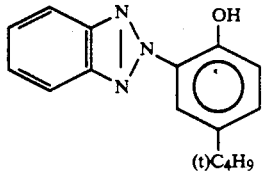
U-3
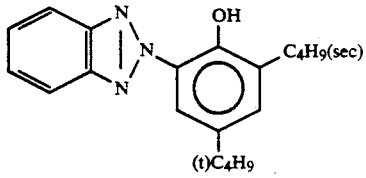
U-4
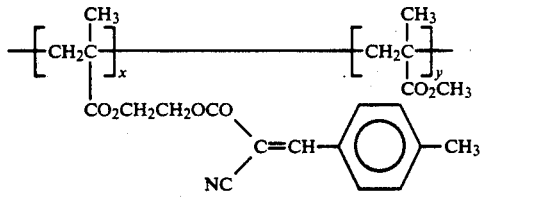
x:y = 70:30 (wt %)
U-5
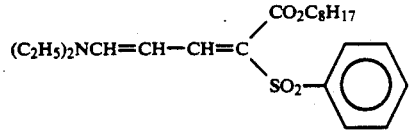
Tricresyl phosphate HBS-1
Di-n-butyl phthalate HBS-2
HBS-3
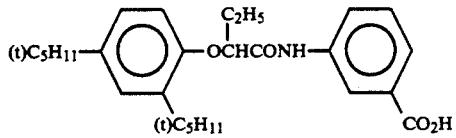

-continued

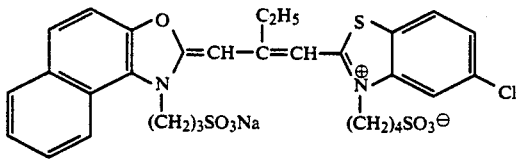

Sensitizing dye I

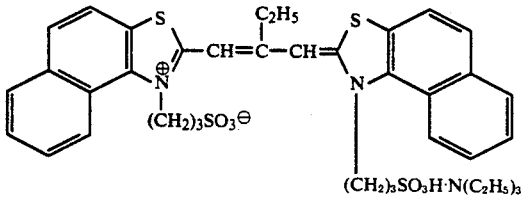

Sensitizing dye II

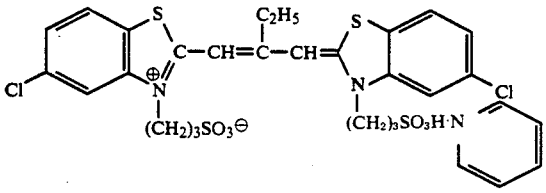

Sensitizing dye III

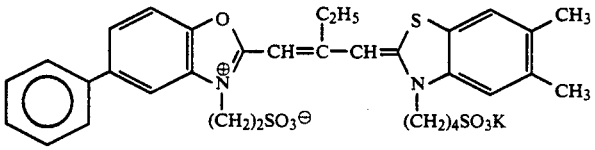

Sensitizing dye IV

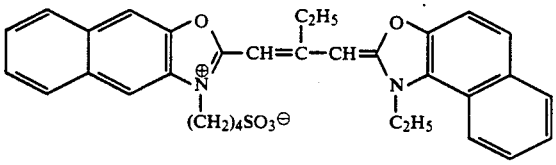

Sensitizing dye V

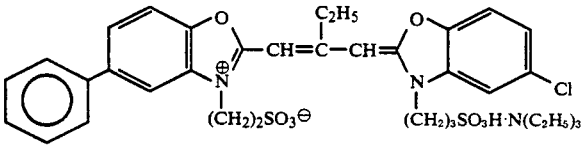

Sensitizing dye VI

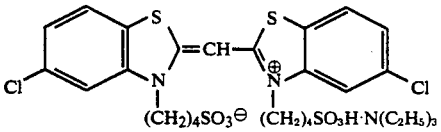

Sensitizindye VII

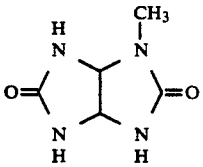

S-1

The thus-prepared sample 102 was exposed to white light (color temperature: 4800° K.) through an optical wedge and then processed in the following stages. In the processing, a microminiature cine system automatic processor was used, and the processing was continued until the accumulated value of the replenishment rate for each processing bath reached 2.5 times the tank capacity. The following results are those obtained by conducting the processing at this point.

| | Processing Stage | | | |
|---|---|---|---|---|
| Stage | Processing Time | Processing temp. | Replenishment rate* | Tank capacity |
| Color development | 1 min. 00 sec. | 45° C. | 10 ml | 2 l |

-continued

| Stage | Processing Stage: Processing Time | Processing temp. | Replenishment rate* | Tank capacity |
|---|---|---|---|---|
| Bleaching (1) | 40 sec. | 43° C. | 5 ml | 1 l |
| Bleaching (2) | 20 sec. | " | | |
| Fixing | 40 sec. | " | 30 ml | 1 l |
| Rinse | 20 sec. | " | 30 ml | 1 l |
| Drying | 40 sec. | 70° C. | | |

*Replenishment rate being per 1 m long by 35 mm wide.

Each processing solution had the following composition.

| | Mother Solution | Replenisher |
|---|---|---|
| Color developing solution | | |
| Diethylenetriaminepentaacetic acid | 2.2 g | 2.2 g |
| 1-Hydroxyethylidene-1,1-diphosphonic acid | 3.0 g | 3.2 g |
| Sodium sulfite | 4.1 g | 4.9 g |
| Potassium carbonate | 38 g | 40 g |
| Potassium iodide | 1.3 mg | — |
| Hydroxylamine sulfate | 2.4 g | 3.3 g |
| 2-Methyl-4-[-N-ethyl-N-(β-hydroxyethyl)amino]aniline sulfate | 13.8 g | 17.0 g |
| 2-methyl-imidazole | 820 mg | 820 mg |
| 5-nitrobenzimidazole | 30 mg | 31 mg |
| 1-Phenyl-4-methyl-4-hydroxymethyl-3-pyrazolidone | 50 mg | 50 mg |
| Water to make | 1000 ml | 1000 ml |
| pH (25° C.) | 10.30 | 10.51 |
| Bleaching solution | | |
| Metal chelate compound described in Table 2 | 0.35 mol | 0.50 mol |
| Ammonium bromide | 80 g | 114 g |
| Ammonium nitrate | 15 g | 21.4 g |
| Acetic acid (90%) | 42 g | 60 g |
| Water to make | 1000 ml | 1000 ml |
| pH | 4.5 | 4.5 |
| Fixing Solution | | |
| The mother solution and the replenisher were the same. | | |
| Ammonium thiosulfate (70%) | 280 ml | |
| Ethylenediaminetetraacetic acid | 10. g | |
| Ammonium sulfite | 28 g | |
| Water to make | 1000 ml | |
| pH | 7.80 | |

After processing, the sample was evaluated in the same way as in Example 1. The results are shown in Table 2.

Comparative compound E

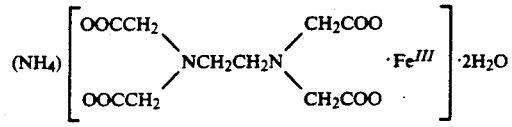

Comparative compound F

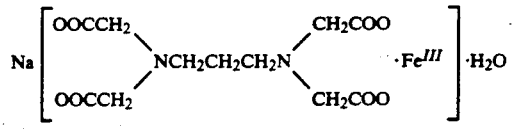

Comparative compound G

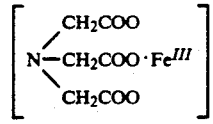

It will be understood from Table 2 that the bleaching solutions containing, as bleaching agents, the metal chelate compounds of the present invention have such excellent performance that they exhibit sufficient ability of bleaching in a short bleaching time and scarcely cause bleach fog and exhibit little increase in stain with time in comparison with comparative bleaching solutions.

EXAMPLE 3

Both sides of a paper support were laminated with polyethylene. The surface of the polyethylene-laminated paper support was subjected to a corona discharge treatment, and a gelatin undercoat layer containing sodium dodecylbenzenesulfonate was then provided thereon. Subsequently, various photographic constituent layers were coated thereon to prepare a multi-layer color photographic paper having the layer structure described below. For blue-, green- and red-sensitive emulsion layers in the multi-layer color photographic paper, the following Emulsions A', B' and C' were used, respectively.

Emulsion A': silver dhlorobromide emulsion cube, a 3:7 (by Ag molar ratio) mixture of larger-size emulsion Al having a mean grain size of 0.88 μm and smaller-size emulsion A2 having a mean grain size of 0.70 μm; coef-

TABLE 2

| No. | Metal chelate compound | Bleaching time (sec) | Amount of residual silver (μg/cm²) | Bleach fog $\Delta D_{min}$(G) | Increase in stain with time $\Delta D_{min}$(G) | Remarks |
|---|---|---|---|---|---|---|
| 201 | Comparative | 40 | 17.2 | 0.01 | 0.82 | Comparison |
| | compound E | 20 | 41.5 | 0.01 | 0.95 | Comparison |
| 202 | Comparative | 40 | 1.1 | 0.28 | 0.30 | Comparison |
| | compound F | 20 | 6.2 | 0.17 | 0.35 | Comparison |
| 203 | Comparative | 40 | 33.5 | 0.06 | 0.51 | Comparison |
| | compound G | 20 | 45.6 | 0.04 | 0.55 | Comparison |
| 204 | Compound 7C | 40 | 0.7 | 0.02 | 0.05 | Invention |
| | | 20 | 1.4 | 0.02 | 0.08 | Invention |
| 205 | Compound 8C | 40 | 0.9 | 0.02 | 0.07 | Invention |
| | | 20 | 1.2 | 0.01 | 0.09 | Invention |
| 206 | Compound 11C | 40 | 0.7 | 0.00 | 0.07 | Invention |
| | | 20 | 0.9 | 0.00 | 0.09 | Invention |
| 207 | Compound 12C | 40 | 1.0 | 0.01 | 0.05 | Invention |
| | | 20 | 1.7 | 0.01 | 0.06 | Invention |
| 208 | Compound 13C | 40 | 1.4 | 0.06 | 0.04 | Invention |
| | | 20 | 2.1 | 0.05 | 0.05 | Invention |
| 209 | Compound 26C | 40 | 1.8 | 0.06 | 0.06 | Invention |
| | | 20 | 2.2 | 0.04 | 0.09 | Invention |

ficient of variation in grain size distribution being 0.08 and 0.10, respectively; 0.3 mol % of AgBr being localized on a part of the surface of grain in each emulsion Emulsion B': Silver chlorobromide emulsion cube, a 1:3 (by Ag molar ratio) mixture of larger-size emulsion B1 having a mean grain size of 0.55 μm and smaller-size emulsion B2 having a mean grain size of 0.39 μm; coefficient of variation in grain size distribution being 0.10 and 0.08, respectively; 0.8 mol % of AgBr being localized on a part of the surface of the grain in each emulsion)

Emulsion C': Silver chlorobromide emulsion (cube, a 1:4 (by Ag molar ratio) mixture of larger-size emulsion C1 having a mean grain size of 0.58 μm and smaller-size emulsion C2 having a mean grain size of 0.45 μm; coefficient of variation in grain size distribution being 0.09 and 0.11, respectively; 0.6mol % of AgBr being localized on a part of the surface of the grain in each emulsion)

Coating solutions were prepared in the following manner.

Preparation of Coating Solution for First Layer 19.1 g of yellow coupler (ExY), 4.4 g of dye image stabilized (Cpd-1') and 0.7 g of dye image stabilizer (Cpd-7') were dissolved in 27.2 cc of ethyl acetate, 4.1 g of solvent (Solv-3') and 4.1 g of solvent (Solv-7'). The resulting solution was emulsified and dispersed in 185 cc of a 10% aqueous gelatin solution containing 8 cc of 10% dodecylbenzenesulfonate to prepare an emulsified dispersion A. Separately, a silver chlorobromide emulsion A' as described above was prepared. The emulsion A' contained the following blue-sensitive sensitizing dyes A and B added thereto ($2.0\times10^{-4}$ mol of each of these two dyes being added to the larger-size emulsion and $2.5\times10^{-4}$ mol of each of these two dyes being added to the smaller-size emulsion, each amount being per mol of silver). The chemical ripening of the emulsion was carried out by adding a sulfur sensitizing dye and a gold sensitizing dye. The above emulsified dispersion A and the silver chlorobromide emulsion A' were mixed and dissolved. A coating solution for the first layer was prepared so as to give the following composition.

Coating solutions for the second layer to the seventh layer were prepared in a similar manner as in the preparation of the coating solution for the first layer. Sodium salt of 1-oxy-3,5-dichloro-s-triazine was used as the hardening agent for gelatin in each layer. Cpd-10' and Cpd-11' as described below were added to each layer in such an amount as to give the total amounts of 25.0 mg/m$^2$ and 50.0 mg/m$^2$, respectively.

Emulsions A', B' and C' used in the first, third and fifth layer, respectively, were spectrally sensitized using the following sensitizing dyes.

Sensitizing dye A for blue-sensitive emulsion Layer (1st layer)

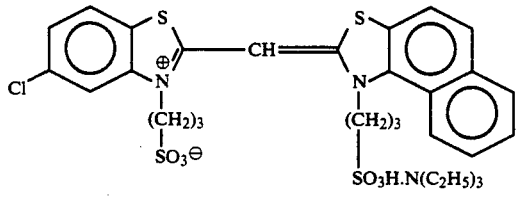

Sensitizing dye B for blue-sensitive emulsion Layer (1st layer)

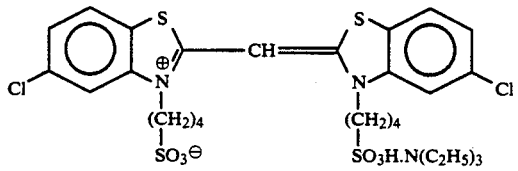

($2.0\times10^{-4}$ mol of each of these dyes were added to the larger-size emulsion A1, and $2.5\times10^{-4}$ mol of each of these dyes being added to the smaller-size emulsion A2, each amount being per mol of silver halide)

Sensitizing dye C for green-sensitive emulsion layer (3rd layer)

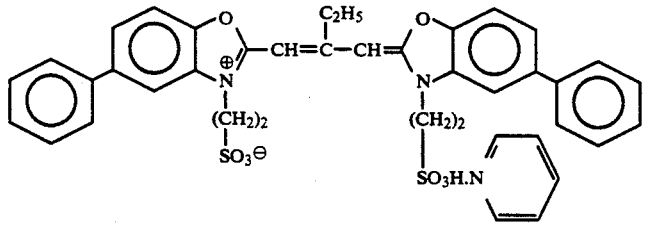

($4.0\times10^{-4}$ mol being were added to larger-size emulsion B1, and $5.6\times10^{-4}$ mol were added to smaller-size emulsion B2, each amount being per mol of silver halide)

Sensitizing dye D for green-sensitive emulsion layer (3rd layer)

-continued

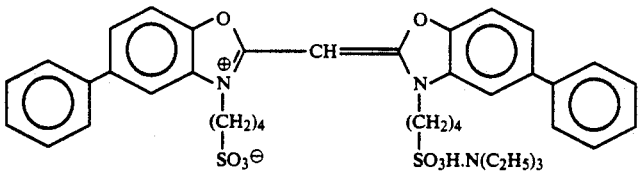

(7.0 × $10^{-5}$ mol being added to larger-size emulsion B1, and 1.0 × $10^{-5}$ mol being added to smaller-size emulsion B2, each amount being per mol of silver halide)

Sensitizing dye E for red-sensitive emulsion layer (5th layer)

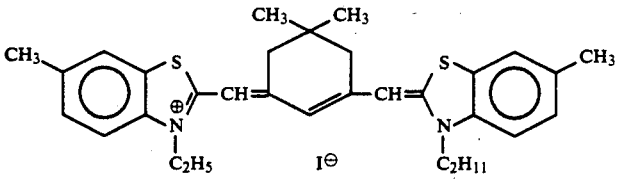

(0.9 × $10^{-4}$ mol were added to larger-size emulsion C1, and 1.1 × $10^{-4}$ mol were added to smaller-size emulsion C2, each amount being per mol of silver halide)

2.6×$10^{-3}$ mol of the following compound per mol of silver halide was added to the red-sensitive emulsion layer (5th layer).

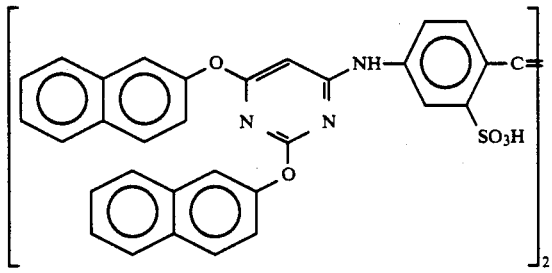

8.5×$10^{-5}$ mol, 7.7×$10^{-4}$ mol and 2.5×$10^{-4}$ mol of 1-(5-methylureidophenyl)-5-mercaptotetrazole were added to the blue-sensitive emulsion layer, the green-sensitive emulsion layer and the red-sensitive emulsion layer, respectively, each amount being per mol of silver halide.

1×$10^{-4}$ mol and 2×$10^{-4}$ of 4-hydroxy-6-methyl-1,3,3a,7-tetrazaindene were also added to the blue-sensitive emulsion layer and the green-sensitive emulsion layer, respectively, each amount being per mol of silver halide.

Further, the following dyes (parenthesized numerals represent coating weights) were added to each emulsion layer to prevent irradiation.

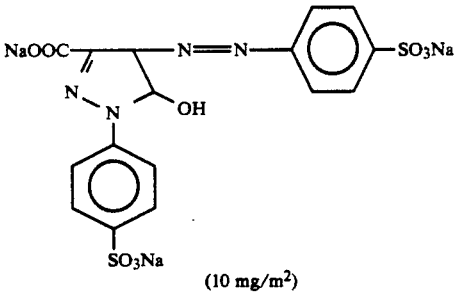

(10 mg/$m^2$)

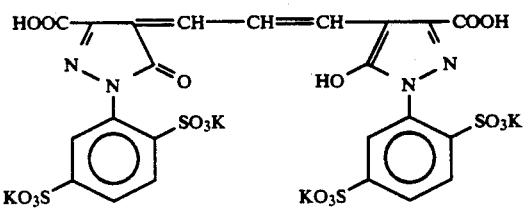

(10 mg/$m^2$)

-continued

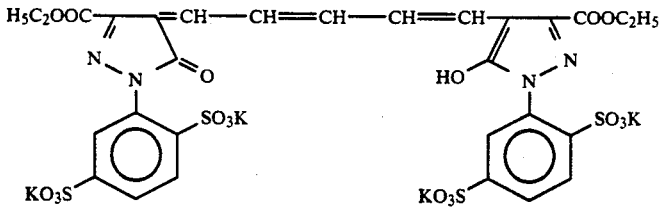

(40 mg/m$^2$)

and

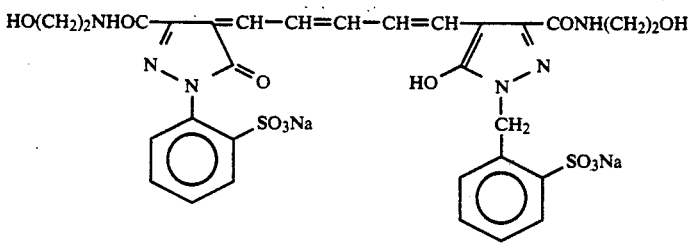

(20 mg/m$^2$)

Layer Structure

Each layer had the following composition. Numerals represent coating weights(g/m$^2$). The amounts of silver halide emulsions are represented by coating weight in terms of silver.

Support

Polyethylene-laminated paper (polyehtylene on the first layer side contained white pigment ($TiO_2$) and bluish dye (ultramarine))

| | |
|---|---|
| First layer (blue-sensitive emulsion layer) | |
| Emulsion A' | 0.30 |
| Gelatin | 1.86 |
| Yellow coupler (ExY) | 0.82 |
| Dye image stabilized (Cpd-1') | 0.19 |
| Solvent (Solv-3') | 0.18 |
| Solvent (Solv-7') | 0.18 |
| Dye image stabilizer (Cpd-7') | 0.06 |
| Second layer (color mixing inhibiting layer) | |
| Gelatin | 0.99 |
| Color mixing inhibitor (Cpd-5') | 0.08 |
| Solvent (Solv-1') | 0.16 |
| Solvent (Solv-4') | 0.08 |
| Third layer (green-sensitive emulsion layer) | |
| Emulsion B' | 0.12 |
| Gelatin | 1.24 |
| Magenta coupler (ExM) | 0.23 |
| Dye image stabilizer (Cpd-2') | 0.03 |
| Dye image stabilizer (Cpd-3') | 0.16 |

-continued

| | |
|---|---|
| Dye image stabilizer (Cpd-4') | 0.02 |
| Dye image stabilizer (Cpd-9') | 0.02 |
| Solvent (Solv-2') | 0.40 |
| Fourth layer (ultraviolet light absorbing layer) | |
| Gelatin | 1.58 |
| Ultraviolet light absorber (UV-1') | 0.47 |
| Color mixing inhibitor (Cpd-5') | 0.05 |
| Solvent (Solv-5') | 0.24 |
| Fifth layer (red-sensitive emulsion layer) | |
| Emulsion C' | 0.23 |
| Gelatin | 1.34 |
| Cyan coupler (ExC) | 0.32 |
| Dye image stabilizer (Cpd-2') | 0.03 |
| Dye image stabilizer (Cpd-4') | 0.02 |
| Dye image stabilizer (Cpd-6') | 0.18 |
| Dye image stabilizer (Cpd-7') | 0.40 |
| Dye image stabilizer (Cpd-8') | 0.05 |
| Solvent (Solv-6') | 0.14 |
| Sixth layer (ultraviolet light absorbing layer) | |
| Gelatin | 0.53 |
| Ultraviolet light absorber (UV-1') | 0.16 |
| Color mixing inhibitor (Cpd-5') | 0.02 |
| Solvent (Solv-5') | 0.08 |
| Seventh layer (protective layer) | |
| Gelatin | 1.33 |
| Acrylic-modified polymer of polyvinyl alcohol (degree of modification: 17%) | 0.17 |
| Liquid paraffin | 0.03 |

The compounds used in the above photographic layers are shown below.

(ExY) Yellow coupler:

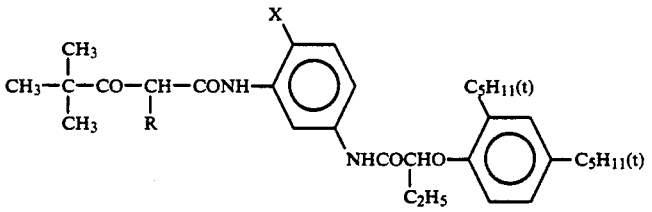

-continued
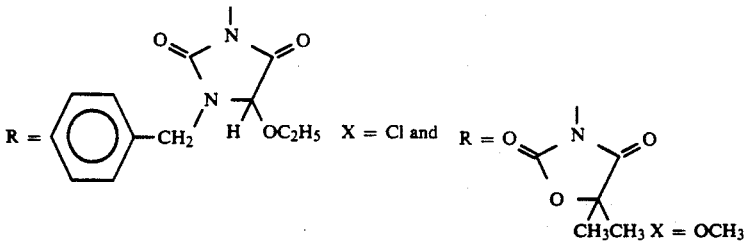
1:1 mixture (by mol)
(ExM) Magenta coupler:
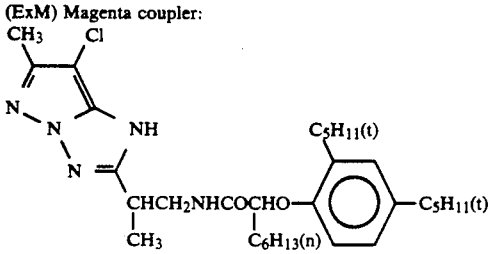
(Exc) Cyan coupler:
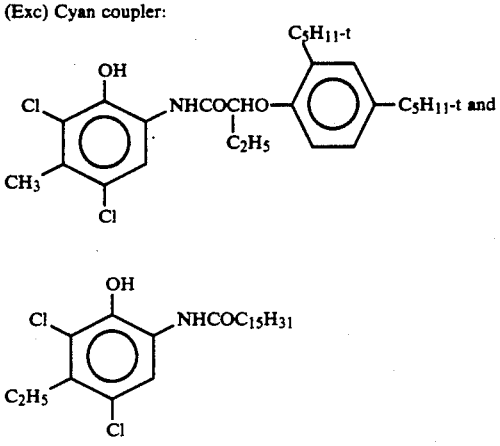
1:1 mixture (by mol)
(Cpd-1') Dye image stabilizer
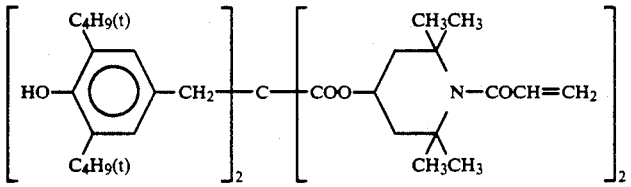
(Cpd-2') Dye image stabilizer
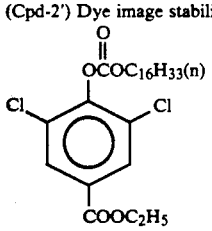
(Cpd-3') Dye image stabilizer
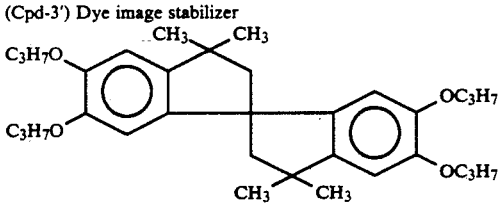
(Cpd-4') Dye image stabilizer
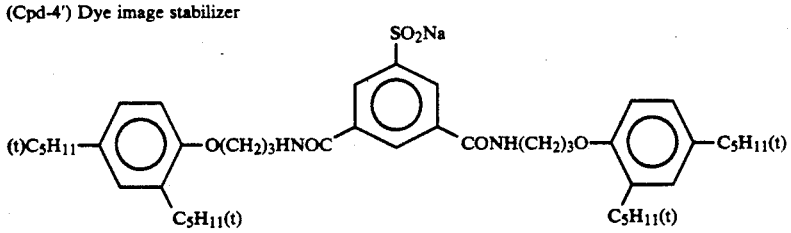
(Cpd-5') Color mixing inhibitor
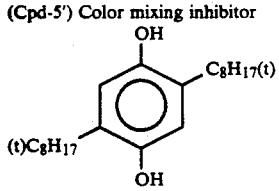
(Cpd-6') Dye image stabilizer
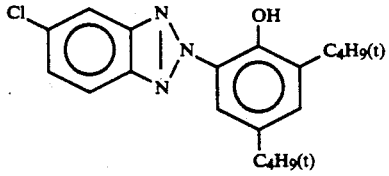

-continued
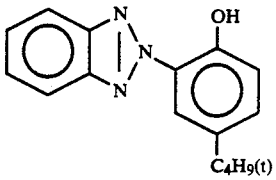
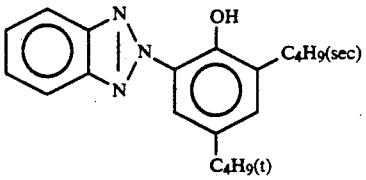
2:4:4 mixture (by weight)
(Cpd-7') Dye image stabilizer
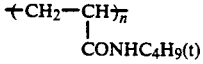
(Average Mw 60,000)
(Cpd-8') Dye image stabilizer
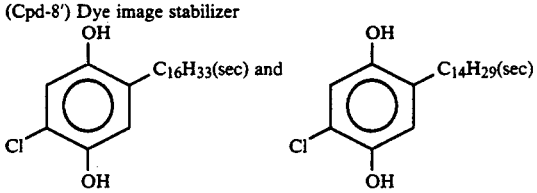
1:1 mixture (by weight)
(Cpd-9') Dye image stabilizer
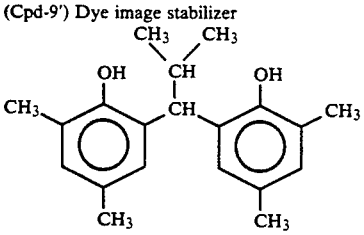
(Cpd-10') Antiseptic acid
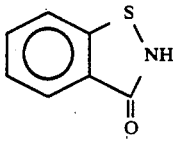
(Cpd-11') Antiseptic agent
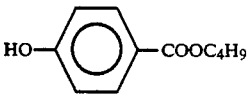
(UV-1') Ultraviolet light adsorber
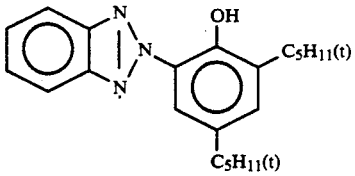
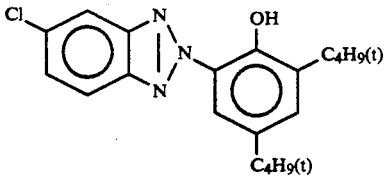
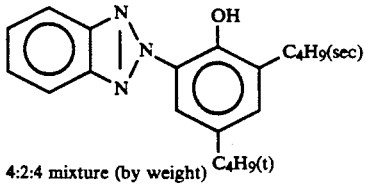
4:2:4 mixture (by weight)
(Solv-1') Solvent
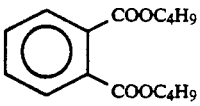
(Solv-2') Solvent
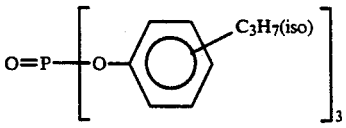
and -continued

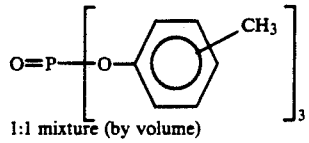

1:1 mixture (by volume)

(Solv-3') Solvent
$O{=}P{+}O{-}C_9H_{19}(iso)]_3$ (Solvent-4') Solvent

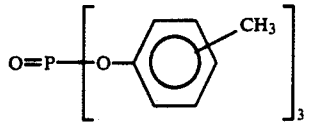

(Solv-5') Solvent

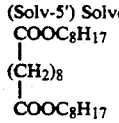

(Solv-6') Solvent

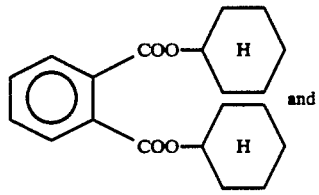

and

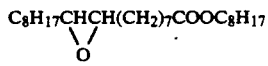

80:20 mixture of (by volume)

(Solv-7') Solvent

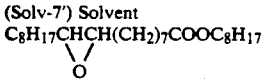

The thus-prepared photographic material was subjected to gradation exposure through an optical wedge by using a light source of 3800° K., and then processed in an automatic processor. The processing was continued until the accumulated value of the replenishment rate exceeded three times the tank capacity. The results obtained by conducting the processing at this point are shown in Table 3.

The amount of residual silver in the maximum density area was measured by X-ray fluorometry. Bleach fog was determined in the following manner. G density in $D_{min}$ area of the above processed sample was measured (1). Separately, the blixing solution was replaced with the following standard blixing solution having no bleach fog, processing was conducted, and G density in $D_{min}$ area of the sample processed with the standard solution was measured (2). A difference in $D_{min}$ between (1) and (2) above was referred to as bleach fog. Further the sample after processing was left to stand at 80° C. and 70% RH for one week, and an increase in stain with time was examined.

| Processing stage | Temp. | Time | Replenishment rate* | Tank capacity |
|---|---|---|---|---|
| Color-development | 39° C. | 45 sec | 70 ml | 20 l |
| Blixing | 35° C. | 45 sec | 60 ml** | 20 l |
| Rinse (1) | 35° C. | 20 sec | — | 10 l |
| Rinse (2) | 35° C. | 20 sec | — | 10 l |
| Rinse (3) | 35° C. | 20 sec | 360 ml | 10 l |
| Drying | 80° C. | 60 sec | | |

*Replenishment rate is per $m^2$ of photographic material.
Three tank countercurrent system of rise (3) → (1) was used.
**In addition to 60 ml described above, 120 ml per $m^2$ of photographic material was allowed to flow from rinse (1).

-continued

| Color developing solution | Mother solution | Replenisher |
|---|---|---|
| Water | 700 ml | 700 ml |
| Diethylene triaminepentaacetic acid | 0.4 g | 0.4 g |
| N,N,N-tris(methylenephosphonic acid) | 4.0 g | 4.0 g |
| Disodium salt of 1,2-dihydroxy-benzene-4,6-disulfonic acid | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightener (Whitex 4 B, a product of Sumitomo Chemical Co., Ltd.) | 1.0 g | 3.0 g |
| Sodium sulfite | 0.1 g | 0.1 g |
| N,N-bis(sulfoethyl)hydroxylamine | 10.0 g | 13,0 g |
| N-Ethyl-N-(β-methanesulfon-amidoethyl)-3-methyl-4-aminoaniline sulfate | 5.0 g | 11.5 g |
| Water to make | 1000 ml | 1000 ml |
| pH (25° C.) | 10.10 | 11.10 |
| Bleaching-fixing solution | | |
| Water | 600 ml | 150 ml |
| Ammonium thiosulfate (700 g/l) | 100 ml | 250 ml |
| Ammonium sulfite | 40 g | 100 g |
| Compound described in Table 3 | 0.155 mol | 0.383 mol |
| Ferric nitrate nonahydrate | 0.138 mol | 0.340 mol |
| Ammonium bromide | 40 g | 75 g |
| Nitric acid (67%) | 30 g | 65 g |
| Water to make | 1000 ml | 1000 ml |
| pH (25° C., adjusted with acetic acid and ammonia water) | 5.8 | 5.6 |
| Standard Blixing solution for evaluation of bleach fog | | |
| Water | | 600 ml |
| Ammonium thiosulfate (700 g/l) | | 100 ml |
| Ammonium sulfite | | 40 g |
| Ammonium ethylenediaminetetraacetato ferrate | | 50 g |
| Ethylenediaminetetraacetic acid | | 5 g |
| Ammonium bromide | | 40 g |

-continued

| | |
|---|---|
| Acetic acid (67%) | 30 g |
| Water to make | 1000 ml |
| pH (25° C.) | 5.8 |

TABLE 3

| No. | Compound | Amount of residual silver (μg/cm²) | Bleach fog $\Delta D_{min}$(G) | Increase in stain with time $\Delta D_{min}$(G) | Remarks |
|---|---|---|---|---|---|
| 301 | Comparative compound A | 2.8 | 0.00 | 0.12 | Comparison |
| 302 | Comparative compound B | 11.6 | 0.03 | 0.04 | Comparison |
| 303 | Comparative compound C | 8.5 | 0.01 | 0.19 | Comparison |
| 304 | Comparative compound D | 2.9 | 0.00 | 0.16 | Comparison |
| 305 | Compound 7 | 0.1 | 0.01 | 0.01 | Invention |
| 306 | Compound 8 | 0.6 | 0.00 | 0.03 | Invention |
| 307 | Compound 11 | 1.0 | 0.00 | 0.03 | Invention |
| 308 | Compound 12 | 0.7 | 0.01 | 0.04 | Invention |
| 309 | Compound 13 | 0.2 | 0.01 | 0.02 | Invention |
| 310 | Compound 26 | 0.9 | 0.00 | 0.02 | Invention |
| 311 | Compound 36 | 0.6 | 0.00 | 0.03 | Invention |

Comparative compound A: ethylenediaminetetraacetic acid
Comparative compound B: 1,3-diaminopropanetetraacetic acid
Comparative compound C: nitrilotriacetic acid
Comparative compound D: cyclohexanediaminetetraacetic acid It will be understood from the results of Table 3 that the blixing solutions containing the metal chelate compounds of the present invention have such excellent performance that they can reduce the amount of residual silver and scarcely cause bleach fog and exhibit little increase in stain after processing in comparison with those containing comparative compounds. The blixing solutions containing comparative compounds exhibited sufficient bleaching ability immediately after the preparation thereof, but they rapidly caused a lowering in performance with time and became greatly cloudy, while the blixing solutions containing the metal chelate compounds of the present invention scarcely became cloudy and were stable.

EXAMPLE 4

The photographic material of Example 3 was subjected to gradation exposure through an optical wedge by using a light source of 3200° K. The exposed sample was processed with the following processing solutions in the following stages.

The amount of residual silver in the maximum density area was measured by X-ray fluorometry. G density in the minimum density area was measured. The sample was left to stand at 80° C. and 70% RH for 8 days, and B density was then measured. The degree of stain formed with time was determined by the difference between the earlier and later measurements.

| Stage | Temp. | Time |
|---|---|---|
| Color development | 40° C. | 15 sec |
| Blixing | 30–35° C. | (1) 20 sec<br>(2) 10 sec |
| Rinse (1) | 30–35° C. | 7 sec |

-continued

| Stage | Temp. | Time |
|---|---|---|
| Rinse (2) | 30–35° C. | 7 sec |
| Rinse (3) | 30–35° C. | 7 sec |
| Rinse (4) | 30–35° C. | 7 sec |
| Drying | 70–80° C. | 15 sec |

A four tank countercurrent system of from rinse (4) to rinse (2) was used.

Each processing solution had the following composition.

| | |
|---|---|
| Color developing solution | |
| Water | 700 ml |
| Diethylene triaminepentaacetic acid | 0.4 g |
| N,N,N-Tris(methylenephosphonic acid) | 4.0 g |
| 1-Hydroxyethylidene-1,1-diphosphonic acid | 0.4 g |
| Triethanolamine | 12.0 g |
| Potassium chloride | 4.9 g |
| Potassium bromide | 0.015 g |
| Potassium carbonate | 29 g |
| Fluorescent brightener (WHITEX 4 B, a product of Sumitomo Chemical Co., Ltd.) | 1.0 g |
| Sodium sulfite | 0.1 g |
| N,N-Bis(sulfoethyl)hydroxylamine | 12.0 g |
| N-ethyl-N-(β-methanesulfonamidoethyl)-3-methyl-4-aminoaniline sulfate | 10.5 g |
| Water to make | 1000 ml |
| pH (25° C.) | 10.15 |
| Blixing solution | |
| Water | 400 ml |
| Ammonium thiosulfate (700 g/l) | 100 ml |
| Ammonium sulfite | 15 g |
| *Compound described in Table 4 | 0.21 g |
| *Ferric nitrate nonahydrate | 0.19 g |
| Ammonium bromide | 40 g |
| Water to make | 1000 ml |
| pH (25° C.) | 6.2 |
| Rinsing solution | |
| Ion-exchanged water (the concentration of each of calcium and magnesium ions being reduced to not higher than 3 ppm) was used. | |

(*The compound was mixed with 200 ml of water, and the mixture was added)

TABLE 4

| No. | Metal chelate compound | Bleaching time (sec) | Amount of residual silver (μg/cm²) | Bleach fog $\Delta D_{min}$(G) | Increase in stain with time $\Delta D_{min}$(G) | Remarks |
|---|---|---|---|---|---|---|
| 401 | Comparative | 20 | 5.1 | 0.01 | 0.24 | Comparison |
| | compound E* | 10 | 9.9 | 0.01 | 0.28 | Comparison |
| 402 | Comparative | 20 | 3.3 | 0.09 | 0.19 | Comparison |
| | compound F* | 10 | 6.2 | 0.07 | 0.22 | Comparison |

TABLE 4-continued

| No. | Metal chelate compound | Bleaching time (sec) | Amount of residual silver ($\mu g/cm^2$) | Bleach fog $\Delta D_{min}$(G) | Increase in stain with time $\Delta D_{min}$(G) | Remarks |
|---|---|---|---|---|---|---|
| 403 | Comparative compound G* | 20 | 15.3 | 0.03 | 0.31 | Comparison |
| | | 10 | 23.7 | 0.02 | 0.42 | Comparison |
| 404 | Compound 4C | 20 | 2.0 | 0.02 | 0.08 | Invention |
| | | 10 | 3.3 | 0.02 | 0.09 | Invention |
| 405 | Comp;ound 7C | 20 | 0.7 | 0.02 | 0.05 | Invention |
| | | 10 | 1.4 | 0.02 | 0.08 | Invention |
| 406 | Compound 8C | 20 | 0.9 | 0.02 | 0.07 | Invention |
| | | 10 | 1.2 | 0.01 | 0.09 | Invention |
| 407 | Compound 11C | 20 | 0.7 | 0.00 | 0.07 | Invention |
| | | 10 | 0.9 | 0.00 | 0.09 | Invention |
| 408 | Compound 12C | 20 | 1.0 | 0.01 | 0.05 | Invention |
| | | 10 | 1.7 | 0.01 | 0.06 | Invention |
| 409 | Compound 13C | 20 | 1.4 | 0.06 | 0.04 | Invention |
| | | 10 | 2.1 | 0.05 | 0.05 | Invention |
| 410 | Compound 26C | 20 | 1.8 | 0.06 | 0.06 | Invention |
| | | 10 | 2.2 | 0.04 | 0.09 | Invention |

*Same as those used in Example 2

It is apparent from Table 4 that the blixing solutions containing the compounds of the present invention have such excellent performance that they are excellent in desilvering property, scarcely cause bleach fog and exhibit little formation of stain with time.

EXAMPLE 5

Color developer specimens 501 to 506 having the compositions shown below were prepared. These developers were each charged in a hard vinyl chloride vessel having an opening area of 10 cm2 and aged at a temperature of 40° C. for 4 weeks. After the ageing test, another batch of these developers were prepared. The two batches were then subjected to the photographic property test as described later. The aged batch was measured for residue of hydroxylamine and color developing agent to determine percent residue of these components with respect to the fresh batch.

| (Color developers 501-506) | |
|---|---|
| Water | 800 ml |
| Potassium carbonate | 32.0 g |
| Sodium bicarbonate | 1.8 g |
| Sodium sulfite | 3.8 g |
| Potassium hydroxide | 1.7 g |
| Metal sequestering agent (compound as set forth in Table 5) | 0.01 mol |
| Ferric chloride (in the form of $Fe^{+3}$) | 0.003 g |
| Potassium bromide | 1.4 g |
| Hydroxylamine sulfate | 2.5 g |
| Potassium iodide | 0.002 g |
| 2-Methyl-4-(N-ethyl-N-β-hydroxylamino) aniline sulfate | 4.7 g |
| Water to make | 1,000 ml |
| pH | 10.05 |

The photographic property test was effected with the above mentioned color developer, and the following bleaching solution, fixing solution and stabilizing solution.

| Bleaching solution | |
|---|---|
| Water | 700 ml |
| Ferric ammonium ethylenediamine-tetraacetate dihydrate | 120.0 g |
| Disodium ethylenediamine-tetraacetate | 10.0 g |
| Ammonium bromide | 100.0 g |
| Ammonium nitrate | 10.0 g |
| Bleach accelerator | 0.005 mol |

-continued

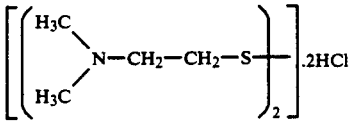

| | |
|---|---|
| 27% Aqueous ammonia | 15.0 ml |
| Water to make | 1,000 ml |
| pH | 6.3 |
| Blixing solution | |
| Water | 500 ml |
| Ferric ammonium ethylenediamine-tetraacetate dihydrate | 50.0 g |
| Disodium ethylenediamine-tetraacetate | 5.0 g |
| Sodium sulfite | 12.0 g |
| 70% Aqueous solution of ammonium thiosulfate | 240.0 ml |
| 27% Aqueous ammonia | 6.0 ml |
| Water to make | 1,000 ml |
| pH | 7.2 |
| Rinsing water | |
| Same as used in Example 1 | |
| Stabilizing solution | |
| Water | 900 ml |
| Hexamethylenetetramine | 5.0 g |
| Polyoxyethylene-p-monononylphenylether (average polymerization degree: 10) | 0.3 g |
| Disodium ethylenediaminetetraacetate | 0.05 g |
| Water to make | 1,000 ml |
| pH | 5.0-8.0 |

| Step | Processing time | Processing temp. |
|---|---|---|
| Color development | 3 min. 15 sec. | 38° C. |
| Bleaching | 1 min. 00 sec. | 38° C. |
| Blixing | 3 min. 15 sec. | 38° C. |
| Rinse (1) | 40 sec. | 35° C. |
| Rinse (2) | 1 min. 00 sec. | 35° C. |
| Stabilization | 40 sec. | 38° C. |
| Drying | 1 min. 15 sec. | 55° C. |

Photographic Property Test

Multilayer color photographic light-sensitive material, sample 102, as prepared in Example 2 was cut into a strip with a width of 35 cm and a length of 12 cm. Half area of the sample was exposed to light with a color temperature of 4,800° K. and 2.5 CMS while the other half area was not exposed. The sample was then processed. The sample thus processed was measured for minimum yellow density (Ymin density) and maximum yellow density (Ymin density) by Type X Light 310 photographic densitometer. The difference of these values from those of fresh batch of color developer 501 were determined, respectively. The results are set forth in Table 5.

TABLE 5

| Color developer | Metal sequestering agent | Kind of color developer | ΔYmin density | ΔYmax density | Percent residue of color developer (%) | Percent residue of hydroxylamine (%) |
|---|---|---|---|---|---|---|
| 501* | Diethylenetriamine-pentaacetic acid | Fresh | 0.00 | 0.00 | 100 | 100 |
| | | Aged | 0.03 | −0.09 | 87 | 64 |
| 502* | Ethylenediamine-tetraacetic acid | Fresh | 0.01 | −0.02 | 100 | 96 |
| | | Aged | 0.15 | −0.15 | 71 | 38 |
| 503 | Compound 11 | Fresh | 0.00 | 0.00 | 100 | 100 |
| | | Aged | 0.01 | −0.05 | 95 | 78 |
| 504 | Compound 7 | Fresh | 0.00 | 0.00 | 100 | 100 |
| | | Aged | 0.00 | −0.03 | 96 | 80 |
| 505 | Compound 4 | Fresh | 0.00 | 0.02 | 100 | 100 |
| | | Aged | 0.01 | −0.06 | 92 | 71 |
| 506 | Compound 30 | Fresh | 0.00 | 0.01 | 100 | 100 |
| | | Aged | 0.02 | −0.06 | 91 | 70 |

*Comparison

Table 5 shows that the metal sequestering agents of the present invention exhibit a higher percent developing agent residue and a higher pecent hydroxylamine residue and thus have a better preservability than diethylenetriaminepentaacetic acid and ethylenediaminetetraacetic acid which are normally incorporated in color developers.

It is also shown that the present metal sequestering agents exhibit minimum yellow density difference, ΔYmin density, (yellow fog) and maximum yellow density difference, ΔYmax density, (coloring property) in fresh batch of color developer 501 similar to that of diethylenetriaminepentaacetic acid and thus cause no problem. The present metal sequestering agents exhibit a smaller change in these values in aged color developer than the comparative developers and thus have an excellent age stability of photographic properties.

EXAMPLE 6

Multilayer color photographic material, sample 102, as prepared in Example 2 was cut into a strip with a width of 35 mm. The sample was then subjected to photographing of a standard outdoor object. 300 m of the sample was then continuously processed in the following processing steps:

TABLE 6

| Stage | Tem. | Time | Tank capacity | Replenishment rate (per $m^2$) |
|---|---|---|---|---|
| Color development | 38° C. | 3 min. 15 sec. | 10 liter | 400 ml |
| Blixing | " | 45 sec. | 4 liter | 130 ml |
| Fixing (1) | " | 45 sec. | 4 liter ← | 400 ml |
| Fixing (2) | " | 45 sec. | 4 liter ← | |
| Rinse (1) | " | 15 sec. | 2 liter ← | |
| Rinse (2) | " | 15 sec. | 2 liter ← | |
| Rinse (3) | " | 15 sec. | 2 liter | 190 ml |
| Stabilization | " | 15 sec. | 2 liter | |
| Drying | 55° C. | | | |

(unit: g/l)

| | Mother solution | Replenisher |
|---|---|---|
| Color developer | | |
| Sodium sulfite | 4.0 | 5.5 |
| Potassium bromide | 1.4 | 0.2 |
| Potassium carbonate | 39.0 | 40.5 |
| Diethylenetriamine-pentaacetic acid | 1.0 | 1.2 |
| 1-Hydroxyethylidene-1,1-diphosphonic acid | 3.3 | 3.7 |
| Hydroxylamine | 2.7 | 4.0 |
| 4-(N-ethyl-N-β-hydroxyethylamino)-2-methylaniline sulfate | 4.5 | 6.5 |
| pH (adjusted with potassium hydroxide) | 10.05 | 10.18 |
| Bleaching solution | | |
| Ferric ammonium 1,3-diaminopropanetetraacetate dihydrate | 140 | 210 |
| 90% Acetic acid | 35 | 50 |
| 70% Hydroxyacetic acid | 97 | 140 |
| Ammonium sulfate | 40 | 60 |
| pH (adjusted with aqueous ammonia) | 3.6 | 2.5 |
| Fixing solution | | |
| Ammonium thiosulfate | 200 | 350 |
| Ammonium sulfite | 20 | 35 |
| Imidazole | 22 | 40 |
| Ethylenediaminetetraacetic acid | 10 | 18 |
| pH (adjusted with acetic acid) | 7.2 | 7.4 |
| Rinsing water | | |
| 20 mg/l of chlorinated sodium isocyanurate was added to tap water having the following contents: | | |
| Calcium | 34 mg/l | |
| Magnesium | 2.0 mg/l or less | |
| pH | 6.5 | |
| Conductivity | 170 μs/cm | |
| Stabilizing solution | | |
| 37% Formalin | 2.0 ml | Same as left |
| Polyoxyethylene-p-monononylphenylether (average polymerization degree: 10) | 0.3 | " |
| Tetrasodium ethylenediaminetetraacetate | 0.05 | " |
| Water (tap water) to make | 1,000 ml | " |
| pH | 5.0–8.0 | " |

A solution was withdrawn from the 1st rinse bath which had been used for processing and then analyzed. The solution has the following composition:

| | |
|---|---|
| Ammonium thiosulfate | 38 g/l |
| Ammonium sulfite | 1.8 g/l |
| Ammonium bromide | 0.8 g/l |
| Magnesium ion | 3 mg/l |

-continued

| | |
|---|---|
| Calcium ion | 37 mg/l |
| Ferric ion | 76 mg/l |
| Silver ion | 0.82 g/l |
| pH | 7.10 |

The above mentioned solution was then equally divided into five batches. Nothing was added to the 1st batch. 1-Hydroxyethylidene-1,1-diphosphonic acid was added to the 2nd batch in an amount of 0.005 mol/l. Sequestering agents of the present invention were added to the 3rd, 4th and 5th batches in amounts of 0.005 mol/l, respectively. These batches were each adjusted with ammonia and acetic acid to a pH value of 7.1. 500 ml of each of these batches was charged in a polyethylene bottle and sealed. These bottled specimens were stored in a 40° C. constant temperature water bath. These specimens were unsealed and poured into a beaker everyday for the observation of the occurrence of silver sulfide due to decomposition of thiosulfates and the precipitation of calcium or the like.

TABLE 7

| Specimen | Metal sequestering agent | Days till generation of silver sulfide |
|---|---|---|
| 1* | None | 6 |
| 2* | 1-Hydroxyethylidene-1,1-diphosphoric acid | 19 |
| 3 | Compound 11 | 21 |
| 4 | Compound 4 | 20 |
| 5 | Compound 7 | 23 |

*Comparison

Table 7 shown that the 2nd batch had been observed to have white string-like precipitates since around 14th day. The analysis of the precipitates showed that the main component of the precipitates was calcium. The other batches showed no such a phenomenon.

The production of silver sulfide can be easily confirmed by observing the production of a black precipitate. The fluorescent X-ray analysis of the black precipitate showed that it is silver sulfide.

The results shown that the metal sequestering agents of the present invention are more excellent than 1-hydroxyethylidene-1,1-diphosphonic acid in that they can serve to inhibit the production of silver sulfide similarly to or more effectively than 1-hydroxyethylidene-1,1-diphosphonic acid and they do not produce any precipitate with calcium.

EXAMPLE 7

| Preparation of developer | |
|---|---|
| Potassium sulfite | 65.0 g |
| Hydroquinone | 30.0 g |
| 4-Methyl-4-hydroxymethyl-1-phenyl-3-pyrazolidone | 1.0 g |
| Chelating agent (as set forth in Table 8) | 10 mmol |
| Potassium hydroxide | 11.0 g |
| Sodium carbonate (monohydrate) | 11.0 g |
| Potassium bromide | 3.0 g |
| 5-Methylbenztriazole | 0.1 g |
| 2-Mercaptobenzimidazole-5-sulfonic acid | 0.1 g |
| Diethylene glycol | 25.0 g |
| Water to make | 1,000 ml |
| pH | 10.70 |

Air Oxidizability of Developer 500 ml of the above mentioned developer was charged in a 500-ml beaker. The beaker was then covered with a sheet of saran film. A 2-mm diameter hole was made in the saran film. The beaker was then allowed to stand at room temperature for 14 days. The specimen was then measured for residue of hydroquinone and potassium sulfite and pH. The results are set forth in Table 8.

TABLE 8

| Developer No. | Chelating agent | pH | Hydroquinone (g/l) | Potassium sulfite (g/l) | Loss of hydroquinone (g/l) | Loss of potassium sulfite (g/l) |
|---|---|---|---|---|---|---|
| 1 | Ethylenediaminetetra-acetic acid | 11.40 | 6.3 | 19.3 | −23.7 | −45.7 |
| 2 | Compound 4 | 11.03 | 19.0 | 40.5 | −11.0 | −24.5 |
| 3 | Compound 7 | 10.87 | 22.0 | 45.0 | −8.0 | −20.0 |
| 4 | Compound 11 | 10.98 | 20.9 | 42.3 | −9.1 | −22.7 |
| 5 | Compound 30 | 10.92 | 21.3 | 43.2 | −8.7 | −21.8 |

Table 8 shown that the present invention can minimize the loss of hydroquinone and potassium sulfite due to their air oxidation and thus inhibit the rise in the pH value of the developer. In other words, a developer excellent in age stability has been realized.

EXAMPLE 8

Running Experiment

A scanner film (FT-87) for LD light source available from Fuji Photo Film Co., Ltd. was exposed to light which had been emitted by a xenon flash lamp for $10^{-6}$ second through an interference filter having a peak at 780 mm and a continuous wedge. The specimen thus exposed was then subjected to running experiment with the developer as used in Example 7 and GF-1 available from Fuji Photo Film Co., Ltd. In particular, the running experiment was effected with automatic developing machine FG-680A available from Fuji Photo Film Co., Ltd. filled with the above mentioned developer and fixing solution under the following conditions:

| | | |
|---|---|---|
| Development | 38° C. | 20 sec. |
| Fixing | 37° C. | 19 sec. |
| Rinse | 25° C. | 18 sec. |
| Drying | 50° C. | 28 sec. |
| Total | | 85 sec. |

The automatic developing machine operated continuously 9 hours a day at a processing temperature for 3 weeks to be ready in processings. 20 sheets (25.4 cm×30.5 cm) of film a half surface of which had been exposed were processed in the automatic developing machine everyday. Then, the above mentioned exposed specimen was processed. The replenishment rate of the developer was as set forth in Table 9, and the replenishment rate of the fixing solution was 300 ml/m$^2$.

Evaluation of Photographic Properties

For the evaluation of photographic properties, sensitivity was determined as reciprocal of the exposure which gives a density of 4.0. Table 9 shows relative sensitivity values. Further, gradation was determined as gradient of the straight line between the point of density of 0.1 and the point of density of 3.0 on the characteristic curve. The results are also set forth in Table 9.

Change in the Composition of Developer

The developer was sampled in a predetermined amount every 7 days for the measurement of pH value and hydroquinone and potassium sulfite concentrations.

The results are set forth in Table 9.

TABLE 9

| | | Developer No. | | | | | |
|---|---|---|---|---|---|---|---|
| | | 1* | 1* | 3 | 3 | 4 | 4 |
| Replenishment rate (ml/m$^2$) | | 200 | 150 | 200 | 150 | 200 | 150 |
| At beginning | Sensitivity | 100 | 100 | 100 | 100 | 100 | 100 |
| | Gradation | 6.2 | 6.2 | 6.2 | 6.2 | 6.2 | 6.2 |
| | pH | 10.7 | 10.7 | 10.7 | 10.7 | 10.7 | 10.7 |
| | Residual H** | 30.0 | 30.0 | 30.0 | 30.0 | 30.0 | 30.0 |
| | Residual KS*** | 65.0 | 65.0 | 65.0 | 65.0 | 65.0 | 65.0 |
| After 1 week | Sensitivity | 85 | 82 | 99 | 98 | 97 | 95 |
| | Gradation | 5.2 | 5.1 | 6.1 | 6.1 | 6.0 | 5.9 |
| | pH | 10.87 | 10.95 | 10.77 | 10.78 | 10.79 | 10.80 |
| | Residual HQ** | 22.3 | 18.0 | 28.0 | 27.3 | 26.6 | 26.2 |
| | Residual KS*** | 51.2 | 45.8 | 60.7 | 59.2 | 59.3 | 57.7 |
| After 2 weeks | Sensitivity | 70 | 65 | 98 | 96 | 95 | 92 |
| | Gradation | 4.1 | 3.9 | 6.1 | 6.0 | 6.0 | 5.8 |
| | pH | 11.04 | 11.20 | 10.83 | 10.85 | 10.86 | 10.90 |
| | Residual HQ** | 16.0 | 12.3 | 27.4 | 24.2 | 23.6 | 23.1 |
| | Residual KS*** | 40.6 | 36.2 | 57.6 | 54.0 | 56.1 | 52.6 |
| After 3 weeks | Sensitivity | 61 | 42 | 97 | 95 | 93 | 89 |
| | Gradation | 3.2 | 3.0 | 5.9 | 5.9 | 5.8 | 5.7 |
| | pH | 11.21 | 11.43 | 10.90 | 10.94 | 10.92 | 10.99 |
| | Residual HQ** | 8.4 | 5.0 | 24.5 | 21.9 | 22.7 | 20.1 |
| | Residual KS*** | 30.0 | 25.1 | 53.7 | 49.2 | 52.3 | 47.9 |

*Comparison
**Residual hydroquinone (g/l)
***Residual potassium sulfite

Table 9 shows that while there are no problems when the developer replenishment rate is high enough, the developer free of the compound of the present invention suffers from a drastic drop in the hydroquinone concentration and a drastic rise in the pH value after running experiment when the developer replenishment rate is low. Under such conditions, the fluctuation in the photographic properties is also great. Thus, the developer free of the compound of the present invention cannot be put into practical use. In accordance with the present invention, high sensitivity and gradation can be maintained for an extended period of time even under running conditions with a developer replenishment rate of less than 200 ml/m$^2$.

A processing solution containing the compound represented by formula (I) of the present invention has the following features:

(1) The oxidation or decomosition of the components of the processing solution due to the action of metallic ions can be inhibited, maintaining the desired properties of the processing solution for an extended period of time;

(2) Even when metallic ions are accummulated, there occurs no precipitation in the solution, eliminating troubles such as stain on film and clogging of filter in the automatic developing machine; and (3) The image storability of the light-sensitive material which has been processed is improved.

A processing solution containing a metal chelate compound formed with the compound represented by formula (I) has the following features:

(1) There occurs no bleach fog and little stain after processing, enabling rapid desilvering; and (2) There occurs little fluctuation in processing properties between before and after running experiment.

While the invention has been described in detail and with reference to specific embodiments thereof, it will be apparent to one skilled in the art that various changes and modifications can be made therein without departing from the spirit and scope thereof.

We claim:

1. A photographic processing composition containing at least one compound represented by formula (I)

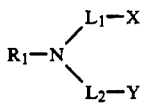

(I)

wherein $R_1$ represents a hydrogen atom, an aliphatic group, or an aromatic group, $L_1$ and $L_2$ each represents an alkylene group having 1 to 3 carbon atoms; X represents a

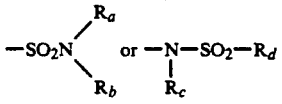

group wherein $R_a$, $R_b$ and $R_c$ each represents a hydrogen atom, an aliphatic group or an aromatic group, and $R_d$ represents an aliphatic group or an aromatic group; and Y represents a carboxy group, a hydroxy group, a phosphono group, a sulfo group or a salt thereof.

2. The photographic processing composition as in claim 1, wherein Y represents —COOM$^1$ group wherein M$^1$ is a hydrogen atom or a cation.

3. The photographic processing composition as in claim 1, wherein $L_1$ and $L_2$ each represent a methylene group or an ethylene group.

4. The photographic processing composition as in claim 1, wherein said compound is represented by formula (III)

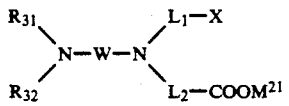

(III)

wherein $L_1$, $L_2$ and X are the same as those set forth in formula (I); $M^{21}$ represents a hydrogen atom or a cation; $R_{31}$ and $R_{32}$ are the same meaning as $R_1$ in formula (I); and W is a divalent bonding group.

5. The photographic processing composition as in claim 4, wherein W is a group represented by $$-(W^1-D)_s-W^2-,$$

wherein $W^1$ and $W^2$ each represents an alkylene group having 2 to 8 carbon atoms, an arylene group having 6 to 10 carbon atom, an aralkylene group having 7 to 10 carbon atom or a cycloalkylene group having 5 to 10 carbon atoms; D represents —O—, —S— or $$-\underset{\underset{R_{12}}{|}}{N}-$$

wherein $R_{12}$ represents a hydrogen atom, a hydrocarbon group, $-L_A-COOM^1$, $-L_APO_3M^2M^3$, $-L_A-OH$ or $-L_A-SO_3M^4$ wherein $L_A$ represents an alkylene group having 1 to 8 carbon atoms or an arylene group having 6 to 10 carbon atoms; and $M^1$, $M^2$, $M^3$ and $M^4$ each represents a hydrogen atom or a cation); and s represents 0 to 3.

6. The photographic processing composition as in claim 1, wherein said compound is contained in an amount of 10 mg to 50 g per liter of the processing composition.

* * * * *